US011590399B1

(12) United States Patent
Davis

(10) Patent No.: US 11,590,399 B1
(45) Date of Patent: Feb. 28, 2023

(54) GOLF TRAINING APPARATUS

(71) Applicant: Charles G. Davis, Laurel, MD (US)

(72) Inventor: Charles G. Davis, Laurel, MD (US)

(73) Assignee: Charles G. Davis, Laurel, MD (US)

( * ) Notice: Subject to any disclaimer, the term of this patent is extended or adjusted under 35 U.S.C. 154(b) by 0 days.

(21) Appl. No.: 17/520,625

(22) Filed: Nov. 5, 2021

(51) Int. Cl.
*A63B 69/36* (2006.01)
*A63B 71/06* (2006.01)

(52) U.S. Cl.
CPC ..... *A63B 69/3667* (2013.01); *A63B 71/06* (2013.01); *A63B 2071/0694* (2013.01); *A63B 2210/58* (2013.01)

(58) Field of Classification Search
CPC ..... A63B 69/3667; A63B 71/06; A63B 2071/0694; A63B 2210/58
USPC ..... 473/218, 265, 266, 267, 270, 272, 273
See application file for complete search history.

(56) References Cited

U.S. PATENT DOCUMENTS

| | | | | | |
|---|---|---|---|---|---|
| 1,517,555 | A | | 12/1924 | Graham | |
| 1,922,130 | A | | 8/1933 | Haserodt | |
| 2,169,407 | A | | 8/1939 | Crowley | |
| 2,457,351 | A | * | 12/1948 | Crowley | A63B 69/3621 473/272 |
| 2,777,697 | A | | 1/1957 | Crossot | |
| 3,141,675 | A | | 7/1964 | Street | |
| 3,580,584 | A | | 5/1971 | Trosko | |
| 3,658,344 | A | | 4/1972 | Kimble | |
| D244,791 | S | | 6/1977 | Sullivan, Jr. | |
| 4,257,608 | A | * | 3/1981 | Funk | A63B 69/3667 473/272 |
| 4,544,161 | A | | 10/1985 | Guendling, Jr. | |
| 5,013,044 | A | | 5/1991 | Hesselbart | |
| 5,314,186 | A | | 5/1994 | Lee | |
| 5,362,060 | A | * | 11/1994 | Hinson | A63B 69/3667 473/218 |
| 5,464,220 | A | * | 11/1995 | Hansen | A63B 69/3667 473/409 |
| 5,482,284 | A | | 1/1996 | Vandever | |
| D372,288 | S | | 7/1996 | Deics | |
| D397,754 | S | | 9/1998 | Nguyen | |
| 5,951,409 | A | * | 9/1999 | Galley | A63B 69/3667 473/218 |
| 6,669,575 | B1 | * | 12/2003 | Marlette | A63B 69/3667 473/270 |
| D569,471 | S | | 5/2008 | Wiersma | |
| 7,927,227 | B2 | | 4/2011 | Radcliffe et al. | |
| 2005/0070370 | A1 | | 3/2005 | Whitaker | |

(Continued)

*Primary Examiner* — Nini F Legesse
(74) *Attorney, Agent, or Firm* — Reston Law Group, LLP; Ralph P. Albrecht

(57) ABSTRACT

A golf training apparatus device may include a ball plate with golf ball spaced markings on a surface; a ball slide including a channel configured to slideably receive the ball plate as a linear guide and configured to enable linear sliding motion of the ball plate relative to the ball slide; a foot plate; a foot slide including a channel configured to slideably receive the foot plate as a linear guide and configured to enable linear sliding motion of the foot plate relative to the foot slide, the foot slide is rotatably coupled to the ball slide, and may include a telescoping member rotatably coupled to one of the slides, and may further include a swing slide rotatably coupled to a swing plate, where the swing slide may be slidably coupled to the ball or foot plate, and the foot plate may include feet.

20 Claims, 28 Drawing Sheets

(56) References Cited

U.S. PATENT DOCUMENTS

| | | | |
|---|---|---|---|
| 2007/0135226 | A1 | 6/2007 | Henderson |
| 2019/0358513 | A1 | 11/2019 | Walton |

* cited by examiner

300

NOTIONAL DEPLOYED STATE

EXAMPLE OF CONFIGURABILITY

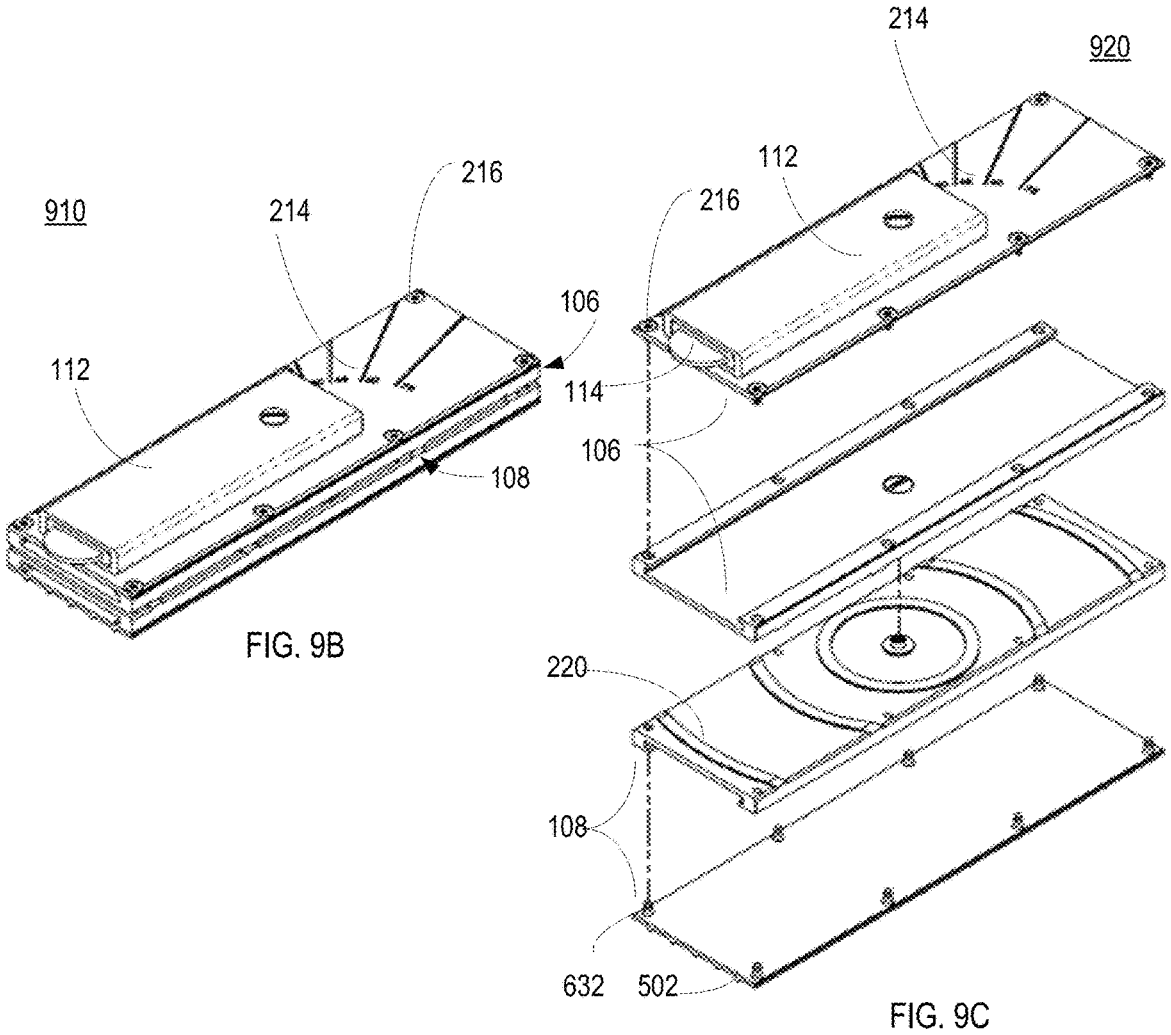
FIG. 9B
FIG. 9C
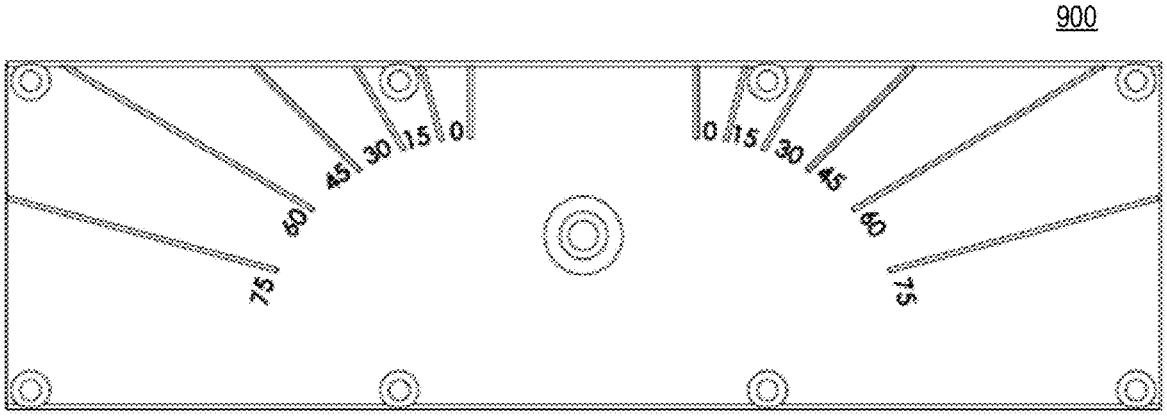
FIG. 9A

1000
FOOT PLATE
1006
1009
1007
1008
1004
1002
FOOT PLATE

1010

EXTRUDED PROFILE FOR BOTH
1020
1026
1024
1022
1027
BALL PLATE
1028

1100

1200

1300

1400

1700

2100

2200

THE CENTER JOINT IS A BARREL STYLE FASTENER. WE WILL PROBABLY USE THIS STYLE FOR THE PROTOTYPE. PRODUCTION UNITS COULD BENEFIT FROM A LOW-PROFILE RIVET TO POSSIBLY MAKE THE HEIGHT LESS

TELESCOPE FASTENER COULD BE THREADED INTO PLASTIC BUT MAY END UP WITH A NUT OF SOME SORT ON THE BACK SIDE

EXEMPLARY PRIMARY COMPONENT FUNCTIONALITY AND EXEMPLARY NONLIMITING DIMENSIONS

CONCEPTUAL EXEMPLARY FUNCTIONALITY OF TELESCOPIC FUNCTION AT, E.G.. TIP, OR ELSEWHERE OF BALL PLATE

EXEMPLARY MARKING FUNCTIONALITY FOR EXEMPLARY BALL PLATE AND FOOT PLATE

2600

TRAVEL POSITION
* SHOWS 12" OF MOVEMENT IN EITHER DIRECTION (SYMMETRIC)

EXEMPLARY MAXIMUM TRAVEL POSITION OF EXEMPLARY LINEAR SLIDES

2700

EXEMPLARY FUNCTIONALITY OF FUNCTIONAL ROTATIONAL SWING

2800

EXEMPLARY STORED CONFIGURATION WITH EXEMPLARY 180 DEGREE SWING.

2900

EXEMPLARY TELESCOPING ANGLE MARKERS

GOLF TRAINING APPARATUS

BACKGROUND OF THE DISCLOSURE

Technical Field of the Disclosure

The disclosure relates generally to sports training devices, and more particularly to golf training devices.

Related Art

Golf is a ball sport in which players use various clubs to hit balls into a series of holes on a course in as few strokes as possible. The winner of a round has the lowest overall number of strokes for the round.

Golf clubs may include, e.g., but not limited to, woods, metal woods, fairway woods, irons, long and short irons, pitching wedges, sand wedges, hybrid clubs, chippers, and putters. Clubs may vary by loft and angle of the face of the club.

Golf, unlike most ball games, cannot and does not use a standardized playing area, and coping with the varied terrains encountered on different courses is a key part of the game. The game at the usual level is played on a course with an arranged progression of 18 holes, though recreational courses can be smaller, often having nine (9) holes. Each hole on the course must contain a teeing ground to start from, and a putting green containing the actual hole or cup 4+¼ inches (11 cm) in diameter. There are other standard forms of terrain in between, such as, e.g., but not limited to, the fairway, rough (long grass), bunkers (or "sand traps"), and various hazards (e.g., but not limited to, water, trees, rocks, cart paths, etc.) but each hole on a course, and between courses, is unique in its specific layout and arrangement.

Golf is played for the lowest number of strokes by an individual, known as stroke play, or the lowest score on the most individual holes in a complete round by an individual or team, known as match play. Stroke play is the most commonly viewed format at all levels, but most especially at the elite level.

The modern game of golf originated in 15th century Scotland. The 18-hole round was created at the Old Course at St Andrews in 1764. Golf's first major, and the world's oldest tournament in existence, is The Open Championship, also known as the British Open, which was first played in 1860 at the Prestwick Golf Club in Ayrshire, Scotland. This is one of the four major championships in men's professional golf, the other three being played in the United States: The Masters, in Augusta, Ga., the U.S. Open, and the PGA Championship. Another US golf tournament is the Players Championship at TPC Sawgrass, in Jacksonville, Fla.

Golf may be played with participants at various skill levels, through a handicapping process, however golfers generally prefer to play with others of similar skill levels. For this reason, golfers often seek to practice or train to improve their ability to strike the ball and to improve their round scores. There are many conventional training methods and tools, including, e.g., practice swinging at a driving range, practice bunkers, practice putting greens, and the like. Some other conventional golf training tools include, e.g., a golf stance and swing practice device US Design Patent No. D244791, a stance indicator for golf, U.S. Pat. No. 1,517,555, a golf stance training device U.S. Pat. No. 5,314,186, a golfer setup device U.S. Pat. No. 4,257,608, a Putt ruler US Patent Publication No. 20190358513, a golf teaching aid US Patent Publication No. 20070135226, and US Patent Publication No. 20050070370, a golfer's stance aid U.S. Pat. No. 3,658,344, a golf teaching aid U.S. Pat. No. D397,754, a golf training aid, U.S. Pat. No. D372,288, a golf ball positioning trainer and stance guide US Patent No D569471, a golf training apparatus U.S. Pat. No. 2,169,407, a golf training and recording apparatus U.S. Pat. No. 2,457,351, a golf practice device and method U.S. Pat. No. 5,464,220, a stance minder for golfers U.S. Pat. No. 5,362,060, a golfer's stance appliance US Patent Publication No. 1922130, a golf instruction device U.S. Pat. No. 2,777,697, training aid for hitting a golf ball U.S. Pat. No. 4,544,161, a stance teaching and practice device U.S. Pat. No. 5,482,284, a golf swing alignment training device U.S. Pat. No. 7,927,227, a training device for golfers U.S. Pat. No. 5,013,044, a combined golf ball and golfer's feet positioning device US Patent Publication No. 3141675, and a golf practice device U.S. Pat. No. 3,580,584, the contents of all of which are incorporated herein by reference in their entireties. Unfortunately, the many conventional training tools have various shortcomings including, many being very large, and inconvenient to use, and lacking in flexibility of features. Many of the tools are too large to place conveniently in a golf bag, or trunk of one's car for availability to practice at a driving range. Thus improved golf training apparatuses remain needed.

What is needed is an improved golf training apparatus that overcomes the shortcomings of conventional golf training systems.

SUMMARY

The disclosure sets forth various exemplary embodiments of golf training apparatuses including, e.g., but not limited to: a golf training apparatus device may include, a first ball plate of rectangular dimensions including a plurality of golf ball spaced markings on a flat upper surface; a ball slide of rectangular dimensions including a first channel configured to slideably receive the first ball plate as a linear guide and configured to enable linear sliding motion of the first ball plate relative to the ball slide in the first channel; a foot plate of rectangular dimensions; and a foot slide of rectangular dimensions including a second channel configured to slideably receive the foot plate as a linear guide and configured to enable linear sliding motion of the foot plate relative to the foot slide in the second channel, wherein the foot slide is coupled to the ball slide, and may include a telescoping member rotatably coupled to at least one of the foot slide and the ball slide, and may further include at least one swing slide rotatably coupled to a swing plate, where the swing slide is slidable coupled to at least one of the ball plate or the foot plate, and wherein the foot plate may include one or more feet, according to an exemplary embodiment.

According to one example embodiment an apparatus can include a golf training apparatus device, which may include, a first ball plate of rectangular dimensions including a plurality of golf ball spaced markings on a flat upper surface; a ball slide of rectangular dimensions including a first channel configured to slideably receive the first ball plate as a linear guide and configured to enable linear sliding motion of the first ball plate relative to the ball slide in the first channel; a foot plate of rectangular dimensions; and a foot slide of rectangular dimensions including a second channel configured to slideably receive the foot plate as a linear guide and configured to enable linear sliding motion of the foot plate relative to the foot slide in the second channel, wherein the foot slide is coupled to the ball slide.

According to one embodiment, the golf training apparatus device may further include where the foot slide coupled to the first ball slide may include at least one or more of: wherein the foot slide is coupled via at least one axle to the ball slide to enable rotation relative to one another; wherein the foot slide is coupled to the ball slide to enable angular rotation of the foot side relative to the ball slide; wherein the foot slide is coupled at a center point of the foot slide via at least one axle to a center point of the ball slide to enable angular rotation of the foot side relative to the ball slide; wherein the foot slide is coupled at a center point of the foot slide to a center point of the ball slide to enable angular rotation of up to 180 degrees of the foot side relative to the ball slide; wherein the foot slide is coupled at a center point of the foot slide to a center point of the ball slide to enable angular rotation of up to 360 degrees of the foot side relative to the ball slide; wherein the foot slide is coupled at a center point of the foot slide to a center point of the ball slide to enable angular rotation of 45 degrees of the foot side relative to the ball slide; or wherein the foot slide and the ball slide are coupled to one another rotatably, by at least one axle passing through an opening in each of the foot slide and the ball slide, and wherein the at least one axle may include at least one or more of a screw, a nut, a barrel, a rivet, an annular member, or a washer.

According to one embodiment, the golf training apparatus device may further include at least one or more of: a telescoping member configured to extend outward in at least one direction, and wherein the telescoping member is coupled to at least one or more of: the first ball plate, the ball slide, the foot plate, or the foot slide; a telescoping member configured to extend outward in at least one direction, and wherein the telescoping member is coupled to at one end of at least one or more of: the first ball plate, the ball slide, the foot plate, or the foot slide; a telescoping member comprising at least two members coupled to one another and configured to telescope outward relative to one another; a telescoping member comprising at least three members coupled to one another and configured to telescope outward relative to one another; a telescoping member comprising a plurality of members coupled to one another and comprising at least one stop to allow extension to a given telescoping distance; a telescoping member comprising a plurality of members coupled to one another and comprising at least one stop to allow extension linearly to a given telescoping distance; a telescoping member comprising a least three members coupled to one another and comprising at least one stop to allow extension linearly to a given telescoping distance; a telescoping member comprising a least three members coupled to one another and comprising at least one stop to allow extension linearly to a given telescoping distance and wherein two of the at least three members include a notch to avoid interference with a rotational access of the telescoping member; a telescoping member comprising at least one opening for receiving at least one axle to allow rotation about the axle, in any of various angular directions; a telescoping member comprising at least one opening for receiving at least one axle to allow rotation about the axle, in any of various angular directions of one or more of: up to 45 degrees in one direction, up to 90 degrees in one direction, up to 180 degrees in one direction, up to 360 degrees in one direction, up to 45 degrees in either of two directions, up to 90 degrees in either of two directions, up to 180 degrees in either of two directions, or up to 360 degrees in either of two directions; a telescoping member rotatably coupled to at least one axle via a screw and barrel connector; a telescoping member rotatably coupled to at least one axle via a screw and nut connector; a telescoping member rotatably coupled to at least one axle via a rivet connector; a telescoping member rotatably coupled to at least one axle via a low profile rivet connector; a plurality of telescoping members coupled to at least one axle; a plurality of telescoping members coupled to at least one slide; a plurality of telescoping members rotatably coupled to at least one slide; or a plurality of telescoping members, wherein each of the plurality of the telescoping members is coupled at one end to at least one or more of: the first ball plate, the ball slide, the foot plate, or the foot slide.

According to one embodiment, the golf training apparatus device may further include where the telescoping member is coupled at a perpendicular angle to at least one or more of: the first ball plate, the ball slide, the foot plate, or the foot slide.

According to one embodiment, the golf training apparatus device may further include where the telescoping member is coupled to at least one axle, and at least one or more of: wherein the telescoping member is rotatably coupled to at least one or more of: the first ball plate, the ball slide, the foot plate, or the foot slide; wherein the telescoping member is rotatably coupled via the at least one axle to a top portion of the foot slide and wherein a bottom portion of the foot slide is coupled by at least one axle to the ball slide, and wherein the telescoping member, the foot slide, and the ball slide rotate independently of each other; or wherein the telescoping member is rotatably coupled via the at least one axle to a top portion of the foot slide and is configured to rotate within a range of negative 90 degrees from an origin to positive 90 degrees from the origin, and wherein a bottom portion of the foot slide is coupled by at least one axle to the ball slide and the foot slide and the ball slide may rotate 360 degrees, and wherein the telescoping member and the foot slide are limited in rotation relative to one another, and the ball slide rotates independently of the telescoping slide.

According to one embodiment, the golf training apparatus device may further include where the foot slide coupled to the ball slide and the first ball plate and the foot plate are all configured to rotate into alignment for storage.

According to one embodiment, the golf training apparatus device may further include where the first ball plate may include at least one or more of: wherein the plurality of golf ball spaced markings each may include at least one or more of: a circular feature marking; a circular etched mark; a circular engraved mark; a circular printed mark; a circular embossed mark; a circular imprinted mark; a circular raised mark; a circular mark of about 1.7 inches a series of circular marks separated by a small gap; a series of circular marks separated by a fraction of one inch gap; a circular feature, each of the circular features comprising a 1.67 inches in diameter circle; or a circular feature, each of the circular features comprising a 1.67 inches in diameter circle, wherein each adjacent pair of the circular features are separated by a distance of 2 inches between centers of the adjacent pair of the circular features; a lower surface comprising at least one lower appendage; or a lower surface comprising at least five lower appendages configured to provide frictional grip to the ground.

According to one embodiment, the golf training apparatus device may further include where the footplate resembles a ruler, on a flat upper surface of the footplate.

According to one embodiment, the golf training apparatus device may further include where the foot plate includes at least one or more of: a plurality of inch tick markings; a plurality of six (6) inch tick markings; a plurality of short and long line tick markings; or a plurality of numeric labels.

According to one embodiment, the golf training apparatus device may further include where the footplate may include a timeline with an origin and numeric labels emanating in two directions.

According to one embodiment, the golf training apparatus device may further include where the footplate may include the timeline with the origin, wherein the origin is at a center point of the footplate, and a plurality of inch tick markings are indicated in either of two directions from the origin marking, and large vertical tick markings at each 6 inches increment from the origin.

According to one embodiment, the golf training apparatus device may further include at least one or more of: a swing plate coupled to a rotatable swing sleeve coupled to slide along the first ball plate, and configured to allow for rotation of the swing plate via an axle; a swing plate coupled to a rotatable swing sleeve coupled to slide along the first ball plate, and configured to allow for rotation of the swing plate via an axle coupled at a center point of the swing plate; a second ball plate coupled to the first ball plate; a second ball plate rotatably coupled to the first ball plate; a second ball plate coupled at a center point of the second ball plate, perpendicularly to an end of the first ball plate; a second ball plate rotatably coupled at a midpoint of the second ball plate, perpendicularly to an end of the first ball plate; a second ball plate rotatably coupled at a center point of the second ball plate, perpendicularly to an end of the first ball plate, wherein the first ball plate and the second ball plate are of different lengths; a second ball plate rotatably coupled at a center point of the second ball plate, configured to be capable of being aligned perpendicularly to an end of the first ball plate, wherein the first ball plate and the second ball plate are of different lengths and coupled by at least one axle; or a second ball plate rotatably coupled at a center point of the second ball plate, configured to be capable of being aligned perpendicularly to an end of the first ball plate, wherein the first ball plate and the second ball plate are of different lengths and coupled by at least one axle, wherein the axle may include a cylindrical screw coupling the second ball plate to the first ball plate.

According to one embodiment, the golf training apparatus device may further include where the foot slide may include at least one or more of: an upper portion and a lower portion coupled to one another forming the channel therethrough of sufficient area to allow the foot plate to slide therethrough; a plurality of portions, the plurality of portions coupled to one another, and at least one of the plurality of portions forming the channel therethrough of sufficient area to allow the foot plate to slide linearly therethrough; a plurality of portions, the plurality of portions coupled to one another, and at least one of the plurality of portions forming the channel therethrough of sufficient area to allow the foot plate to slide linearly therethrough, and wherein at least one of the plurality of portions may include a cross-section comprising at least one of: a c-shape, a u-shape, a v-shape, or a j-shape; a plurality of portions, the plurality of portions coupled to one another by a plurality of screws; an upper portion comprising an origin and angular protractor angle indications of a plurality of angles; or an upper portion comprising a plurality of origins on each of a left and a right side, each indicating angular protractor angle indications of a plurality of angles.

According to one embodiment, the golf training apparatus device may further include where the axle may include at least one or more of: a barrel type fastener; a screw and a nut; a rivet; a low profile rivet; a plastic screw; a metal screw; a threaded screw and threaded hole; a self-threading screw; a cylindrical member; or a rotatable lazy-susan ball bearing coupling.

According to one embodiment, the golf training apparatus device may further include where the foot plate further may include at least one or more of: a foot coupled to an end of the foot plate; a foot coupled to an end of the foot plate configured to prevent the foot plate from sliding out of the foot slide in at least one direction; a foot coupled at an end of the foot plate configured to contact the ground at the end of the footplate; a plurality of feet each coupled at a respective end of the foot plate; plurality of feet each coupled at a respective end of the foot plate configured to prevent the foot plate from sliding out of the foot slide in either direction; or a plurality of feet each coupled at a respective end of the foot plate configured to contact the ground at the respective ends of the footplate.

According to one embodiment, the golf training apparatus device may include where the at least one of the foot plate, the ball plate, a swing plate, the foot slide, the ball slide, a swing slide, or a telescoping member are manufactured from a metal material comprising at least one or more of: aluminum, magnesium, steel, stainless steel, or titanium.

According to one embodiment, the golf training apparatus device may include where the at least one of the foot plate, the ball plate, a swing plate, the foot slide, the ball slide, a swing slide, or a telescoping member are manufactured from a material comprising at least one or more of: a metal, polymer, plastic, wood, bamboo, carbon fiber composite, synthetic, hybrid, composite, polyolefins, polycarbonate, polyvinyl chloride (PVC), Polyurethanes, Cyanoacrylate adhesive, Nylon, Polyester, Kevlar, Graphite, Boron, Wood, Metal, Iron, Zinc, Synthetic leather, Rubber, Neoprene, Cloth, Rubber, Silicone rubber, Polymers, Fillers, Vulcanizing agents, Processing aids, ABS plastic, Additive manufacturing extruded materials, S-glass materials, Silicon dioxide, Aluminum oxide, Magnesium oxide, Calcium oxide, Aluminum oxide, Boron, Polyoxymethylene, Thermoplastic Polyester Elastomer, Polybutylene Terephthalate, Polyethylene Terephthalate, gutta-percha/polyisoprene, surlyn copolymer, Die cast aluminum, heavy section steel (HST) steel, wood and metal, Carbon steel, Aluminum Sulfate, AL 6061-T6, Anodized Aluminum, anodized clear finish, 6061 aluminum, 304 stainless steel, 431 stainless steel, 17-4 stainless steel, 6-4 Titanium, 15-5 stainless steel, Beta titanium, Maraging metal, cellular, ceramic, glass, aluminum, steel, stainless steel, or titanium.

BRIEF DESCRIPTION OF THE DRAWINGS

The accompanying drawings, which are included to provide a further understanding and are incorporated in and constitute a part of this specification, illustrate exemplary, and nonlimiting embodiments and together with the description serve to explain the principles disclosed herein. In the drawings, like reference numbers may indicate substantially similar, equivalent, or exemplary elements, and the left most digits in the corresponding reference number indicate the drawing in which an element first appears.

The subject matter disclosed herein is particularly pointed out and distinctly claimed as set forth in the claims at the conclusion of the specification. The foregoing and other objects, features and advantages will be apparent from the following detailed description taken in conjunction with the accompanying drawings, of which:

FIGS. 9A, 9B, and 9C depict a top view of a top portion of the coupled telescoping member to base upper portion of the foot slide having angular protractor markings for directional aiming of the telescoping rotatable module of FIG. 8 coupled to the ball slide, in a collapsed, fully assembled isometric view of the multiply rotatable module, an exploded view of the module showing the separate top portion of the foot slide with telescoping portion collapsed and attached thereto, a bottom portion of the foot slide, and a top portion of the ball slide above a lower portion of the ball slide, the respective pairs of top and bottom portions, serving to form a respective slot for slideably receiving through members (foot plate, and ball plate, respectively, neither shown here), respectively, according to an exemplary embodiment of the present invention;

DETAILED DESCRIPTION OF VARIOUS EXEMPLARY EMBODIMENTS

Figure 1:
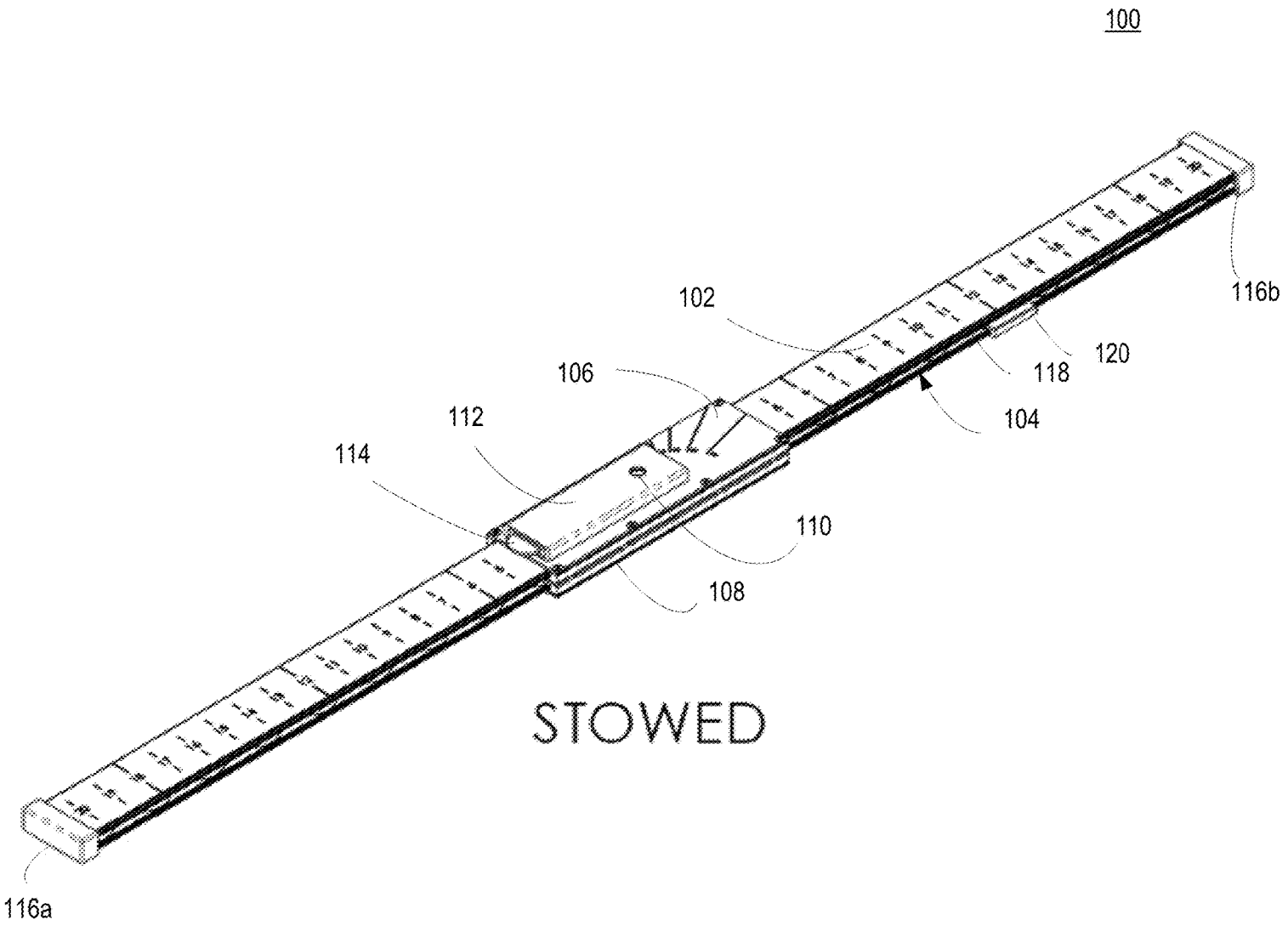
FIG. 1 depicts an isometric view of an example embodiment of a golf training apparatus, in an example stowed configuration, in accordance with an exemplary embodiment of the present invention.

It is important to note that the embodiments disclosed are only examples of the many advantageous uses of the innovative teachings herein. In general, statements made in the specification of the present application do not necessarily limit any of the various claims. Moreover, some statements may apply to some exemplary features but not to others. In general, unless otherwise indicated, singular elements may be in plural and vice versa with no loss of generality. In the drawings, like numerals refer to like parts through several views.

Figure 2:
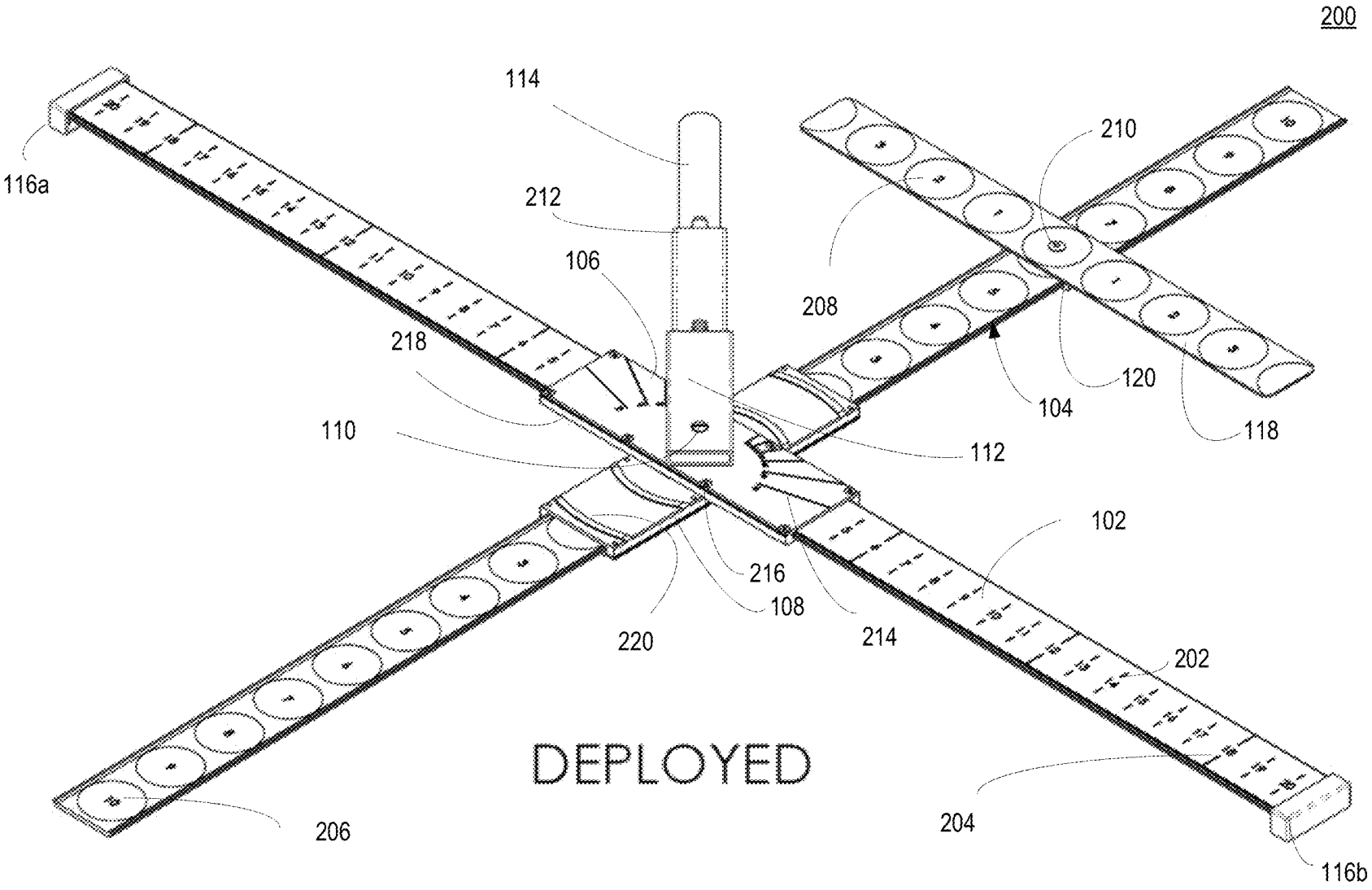
FIG. 2 depicts an isometric view of the example embodiment of the golf training apparatus of FIG. 1, in an example deployed configuration, in accordance with an exemplary embodiment of the present invention.

FIG. 1 depicts an isometric view 100 of an example embodiment of a golf training apparatus, in an example stowed configuration, including an example foot plate 102 with exemplary numeric markings, with foot plate feet 116*a*, 116*b* on either end, an example ball plate 104, an example foot slide 106 configured to slideably receive the foot plate 102, an example ball slide 108 configured to slideably receive the ball plate 104, for example in an exemplary channel like a linear slide, the slides 106, 108 joined by one or more axles 110 for enabling rotation of the slides about the axle, an example telescoping member 112, which may include one or more telescoping sub-element members 114, where telescoping member 112, which may be formed like a linear slide in two or more sub-elements 114, being rotatably coupled to at least one axle 110 to allow rotation about the foot slide 106, as shown in greater detail in deployed position in FIG. 2, and an example swing plate 118 (stowed), and swing plate slide 120, in accordance with an exemplary embodiment of the present invention.

FIG. 2 depicts an isometric view 200 of the example embodiment of the golf training apparatus of FIG. 1, in an example deployed configuration, illustrating example foot plate 102 with example markings 202, 204, end foot or feet 116*a*, 116*b*, slideably coupled to the foot plate 106, and showing an example bottom portion 218 of the foot slide 106, coupled to a top portion 214 of the foot slide 106 by one or more example coupling screws 216, the top portion 214 shown with example angular markings like a protractor, and the bottom portion 218 rotatably coupled at an upper portion 220 of ball slide 108, to the ball slide 108, with one or more raised support surfaces on an upper surface as shown, configured to enable rotational stability, and reduced friction, and the ball slide 108 receiving slideably in a channel the ball plate 104 shown with example ball markings 206, as well as the telescoping member 112, shown in deployed fashion with example telescope sub-elements 114, 212, in an example 3 element linear slide embodiment of the telescope 112, shown rotatably coupled by an axle to the upper portion 214 of the foot plate 106, and an example swing plate 118 rotatably coupled to the swing slide 120 by an axle 210, where the swing slide 120 includes a channel to allow sliding of the swing slide 120 along the foot plate 104, the swing plate 118, as shown including one or more ball symbols 208 in accordance with an exemplary embodiment of the present invention. Note markings on the plates are exemplary but not limiting, and may differ in size and/or orientation, numbers, letters, and/or other symbols, and/or may be in other orientation(s), such as, e.g., but not limited to, as shown and/or 90 degrees or orthogonal to orientations shown, and/or at other angles to the length of the plates, and/or as shown.

Figure 3:
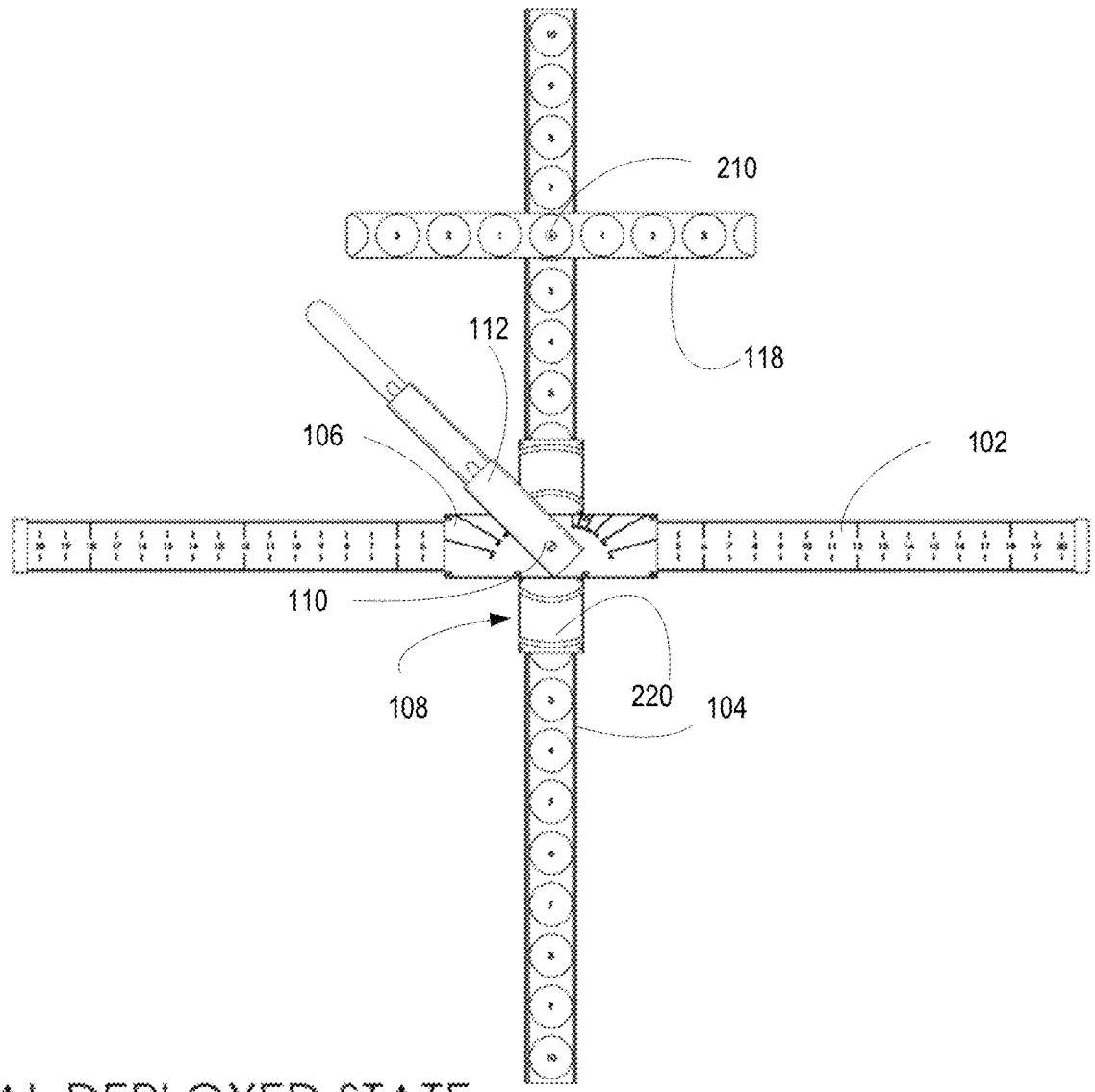
FIG. 3 depicts an exemplary top view of the example embodiment of the golf training apparatus of FIG. 1, in an example notional deployed state configuration, in accordance with an exemplary embodiment of the present invention.

FIG. 3 depicts an exemplary top view of the example embodiment of the golf training apparatus of FIG. 1, in an example notional deployed state configuration, showing the swing plate 118 oriented in an exemplary perpendicular position relative to the ball plate 104, foot plate 102 oriented in an exemplary perpendicular rotated position relative to the ball plate 104, and telescoping member 112 shown deployed at an exemplary arbitrary angle fully telescoped, and in accordance with an exemplary embodiment of the present invention. Any of various other rotational deployed states may also be used, as will be understood to those skilled in the relevant art, since the swing plate 118 (also sometimes referred to herein as a second ball plate because of including example ball markings as shown) and ball plate 104 (also sometimes referred to as a first ball plate) are fully rotatable 360 degrees about axle 210 from swing slide 120, and since the foot plate 102 and ball plate 104 are fully rotatable 360 degrees about an axle below and on the same axis as axle 110 from foot slide 106 and ball slide 108 being rotatably coupled via an axle below 110 (not shown here, but shown in FIG. 6 below), and telescoping member 112 is fully rotatable 360 degrees about foot slide 106 as coupled via axle 110.

Figure 4:
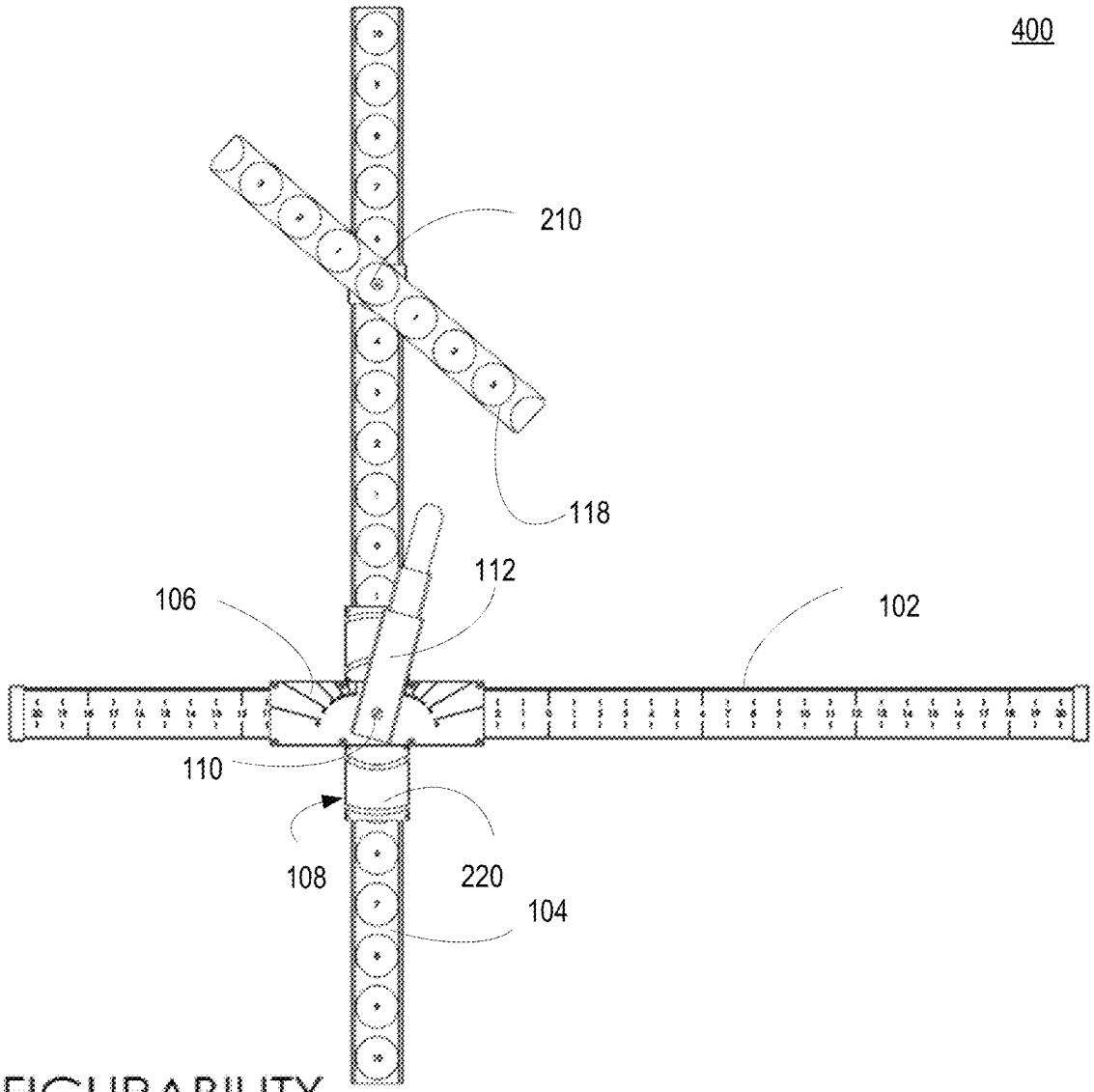
FIG. 4 depicts an exemplary top view of the example embodiment of the golf training apparatus of FIG. 1, in an example of configurability, in accordance with an exemplary embodiment of the present invention.
Figure 5A:
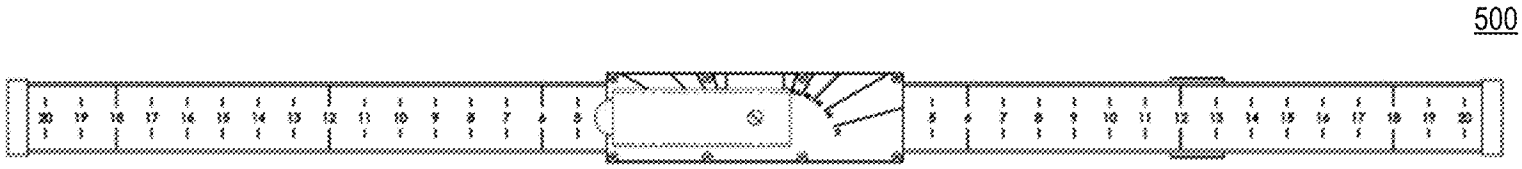
FIGS. 5A, 5B, 5C, and 5D depict a top view, front view, right edge view, and bottom view, respectively, of the example embodiment of the golf training apparatus of FIG. 1, according to an exemplary embodiment of the present invention.
Figure 5B:
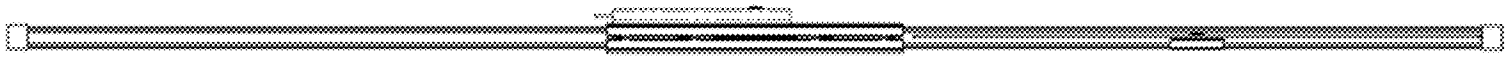
Figure 5C:
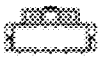
Figure 5D:
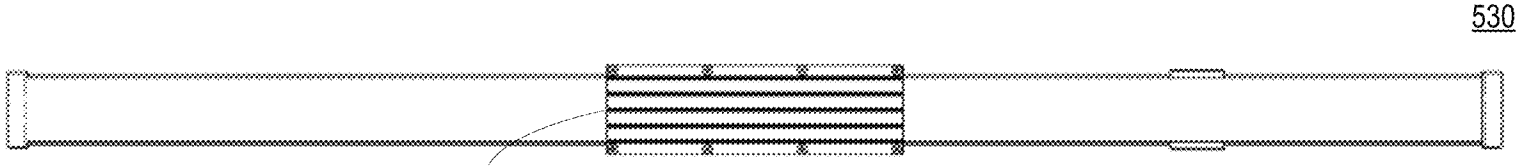

FIG. 4 depicts an exemplary top view of the example embodiment of the golf training apparatus of FIG. 1, in an example of configurability in a different position with swing plate 118 rotated at an example arbitrary angle relative to ball plate 104, ball plate 104 slid linearly at an example arbitrary position along ball slide 108, foot plate 102 slid linearly at an example arbitrary position along foot slide 106, and telescoping member 112 shown rotated at an example arbitrary rotation position relative to the foot slide 106 about axle 110, in accordance with an exemplary embodiment of the present invention.

FIGS. 5A, 5B, 5C, and 5D depict, respectively, a top view 500, front edge view 510, right edge view 520, and exemplary bottom view 530 including example bottom view of the exemplary ball slide 108 showing example foot ridges 502 on the bottom surface of the ball slide 108, extending approximately to the bottom or below the bottom surface of the feet 116*a*, 116*b* of foot plate 102, of the example embodiment of the golf training apparatus of FIG. 1, in the stowed, collapsed, non-telescoped, nondeployed orientation, according to an exemplary embodiment of the present invention.

FIGS. 6A, 6B, 6C, and 6D depict, respectively, a back edge view 600 of the apparatus of FIG. 5, a cross-sectional view 610 of section A-A 602 of 600 showing two axles, the first axle 110*a* and bottom nut 68 coupling the telescoping member 112 at top to elongate portion 612 of the top portion 214 of the foot slide 106, and the second axle 110*b* and bottom nut 610 below coupling the bottom portion 218 of the foot slide 106 to a top portion 220 of the ball slide 108, shown with foot plate 102 in a channel of foot slide 106, and ball plate 104 in ball slide 108, a cross-sectional view 620 of section B-B 604 of 600 illustrating the axle 210 screw coupling with a nut 624 coupling the swing slide 120 to the swing plate 118, the swing slide 120 configured with a channel to slide along the ball plate 104 as shown, and foot plate foot 116*a* is show with exemplary one or more inner protrusions configured to receive other members when in stowed position, as shown, including ball plate 104, and foot plate 102, and a cross-sectional view of section C-C 606 of 600 illustrating coupling via example screw 216 the top portion 214 of foot slide 106 to the bottom portion 218 of foot slide 106, and other screws 632 couple bottom portion 502 of the ball slide 108 to the top portion 220 of the ball slide 108, according to an exemplary embodiment of the present invention. As will be apparent to those skilled in the relevant art, other couplers other than screw and nut may be used including, e.g., but not limited to, rivets, other rotatable axles, etc.

Figure 7:
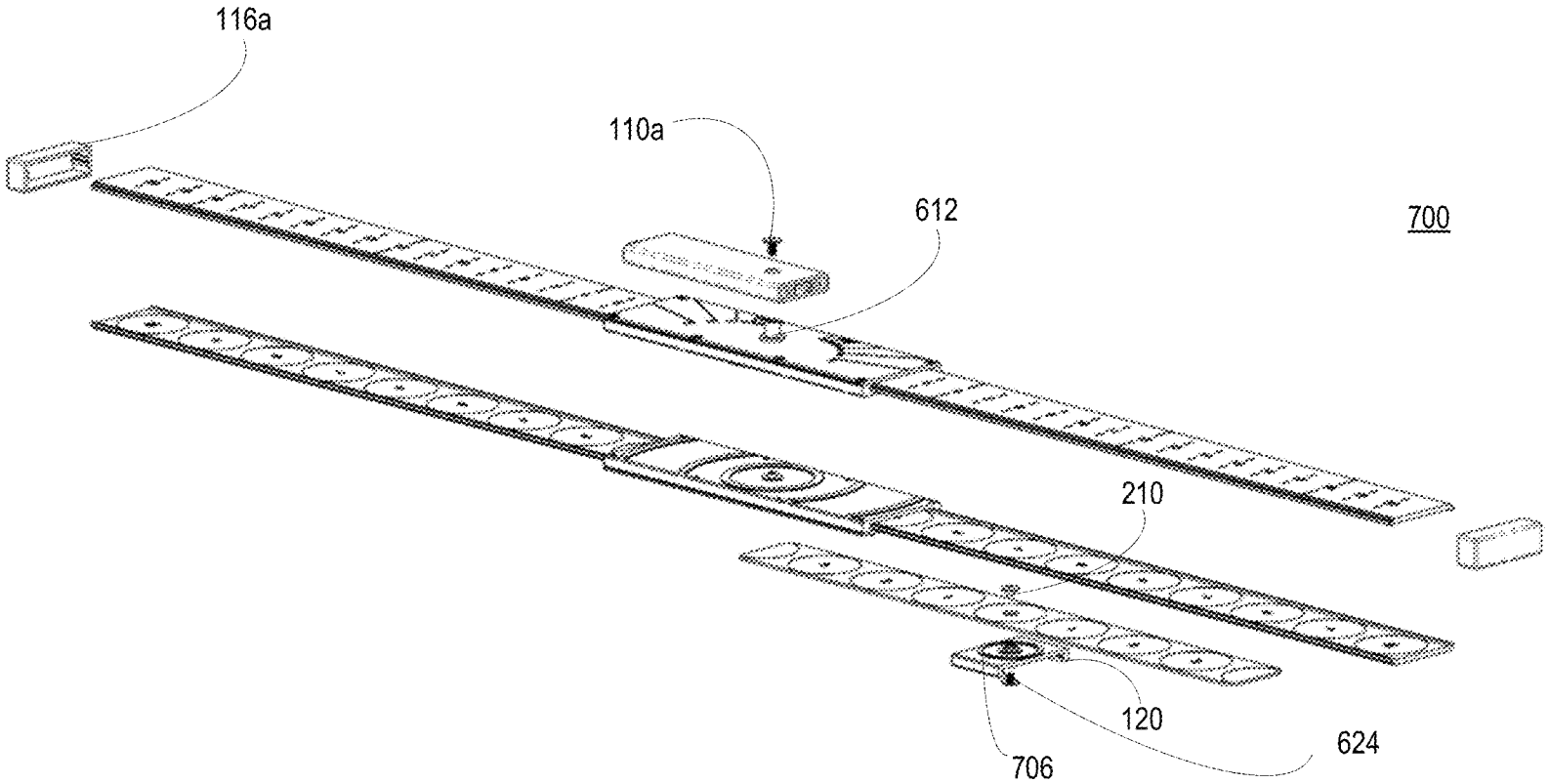
FIG. 7 depicts an isometric exploded view of the apparatus of FIG. 1, according to an exemplary embodiment of the present invention.
Figures 8A, 8B, 8C, 8D, 8E, 8F, 8G, 8H:
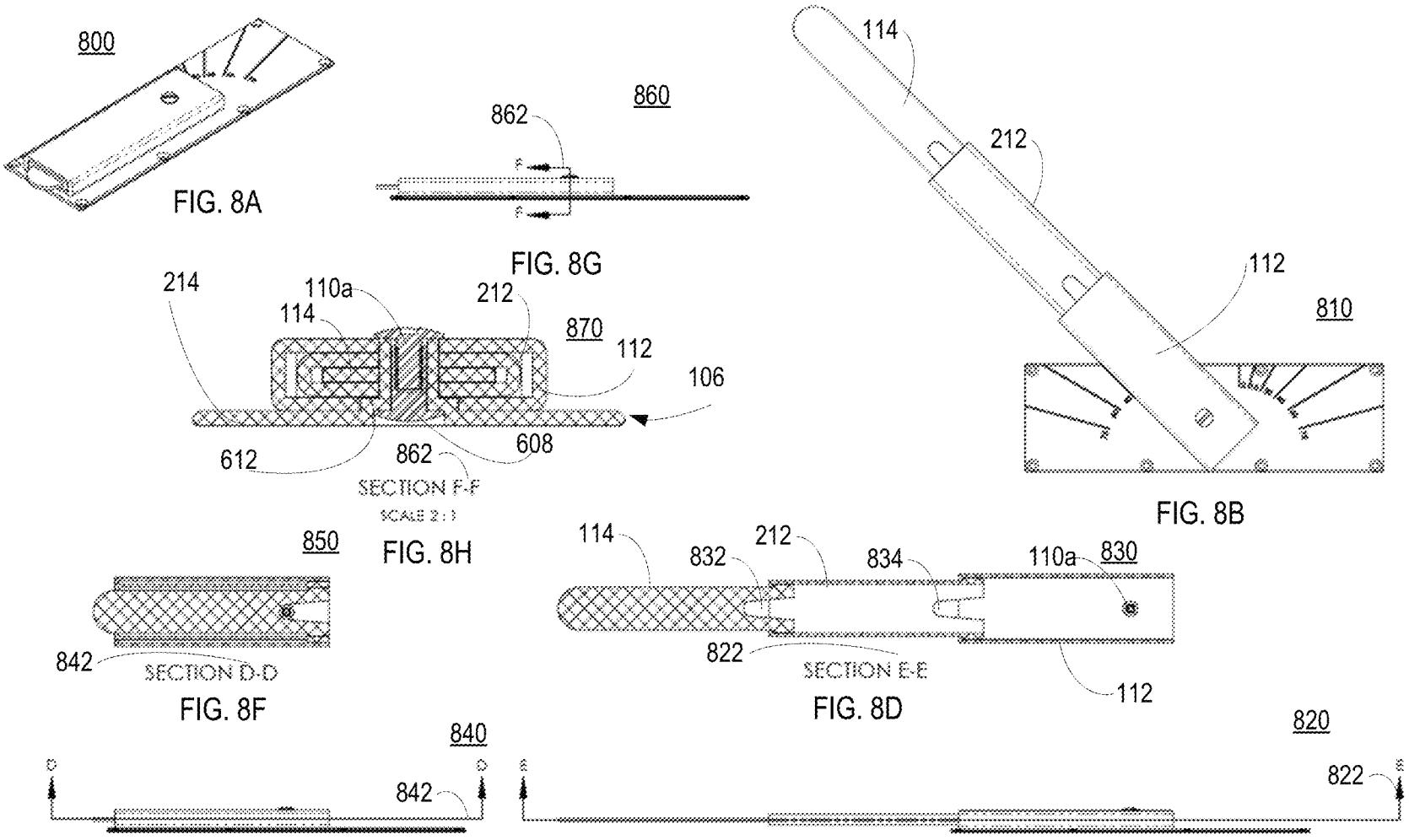
FIGS. 8A, 8B, 8C, 8D, 8E, 8F, 8G, and 8H depict an isometric view of an exemplary telescoping rotatable module in collapsed configuration, a top extended view of the module fully expanded, a front edge view of the extended view of the module showing E, a top cutaway section E-E of the front edge view of the extended view of the module, a front edge view of the collapsed module showing D, a top cutaway section D-D of the front edge view of the collapsed module, a front edge view of the collapsed module showing F, a cross-sectional view of section F-F of the front edge view of the collapsed module, respectively, according to an exemplary embodiment of the present invention.

FIG. 7 depicts an isometric exploded view of the apparatus of FIG. 1, illustrating the elongate portion 612, foot 116*a*, axle screw 110*a*, axle screw 210, nut 624, example circular protrusion 704 of swing slide 120 for reduced friction during rotation of swing slide 120, illustrated in exploded fashion for ease of viewing, and method of assembly for making the device 100, according to an exemplary embodiment of the present invention.

FIGS. 8A, 8B, 8C, 8D, 8E, 8F, 8G, and 8H depict, respectively, an isometric view 800 of an exemplary telescoping rotatable member 112 module 800 in collapsed configuration, a top extended view 810 of the module fully expanded, a front edge view 820 of the extended view of the module showing section E-E 822, a top cutaway view 830 of section E-E 822 of the front edge view 820 of the extended view 810 of the module 800 showing example notches 832 and 834 allowing for stowage of the example telescoping sub-elements 114 and 212, respectively, to avoid interference with axle 110*a* when stowed as shown in 850, a front edge view 840 of the collapsed module 800 showing section D-D 842, a top cutaway view 850 of section D-D 842 of the front edge view 840 of the collapsed module 800 shown in stowed position, a front edge view 860 of the collapsed module 800 showing section F-F 862, a cross-sectional view 870 of section F-F 862 of the front edge view 860 of the collapsed module 800, illustrating, an example coupling axle 110*a* screw and example nut 608 configured to couple the telescoping member 112 and example sub-elements 114, 212, to the protrusion 612 of the top portion 214 of foot slide 106, which serves as a base of the module 800, according to an exemplary embodiment of the present invention.

FIGS. 9A, 9B, and 9C depict, respectively, a top view 900 of a top portion 214 of the foot slide 106, which serves as the base of the module of 800, shown with example angular protractor markings, which may be printed on a top surface and/or etched by laser, or the like, etc., according to exemplary embodiments, and may receive the telescoping member 112 to form the telescoping rotatable module 800 of FIG. 8, a collapsed isometric view 910 of the module 800 assembled and coupled to the foot slide 106 and ball slide 108 to form a complete multiply-rotatable module 910 as shown, an exploded view of the module showing the top portion of the base with telescoping portion collapsed already attached and assembled as shown in FIGS. 8, a bottom portion of the foot slide helping couple the foot slide 106 the base of the module 800 by assembly of screws 216, and the upper portion of the ball slide 220 coupled to the bottom portion of the ball slide 502, coupled together by one or more screws 632, with assembly method as shown to couple the foot slide 106 to the ball slide 108 rotatably by screws and nuts as shown in FIG. 6 of the base, serving to form channels or slots for slideably receiving through members (foot plate 102, and ball plate 104, respectively, therein, neither shown), according to an exemplary embodiment of the present invention.

Figures 10A, 10B, 10C:
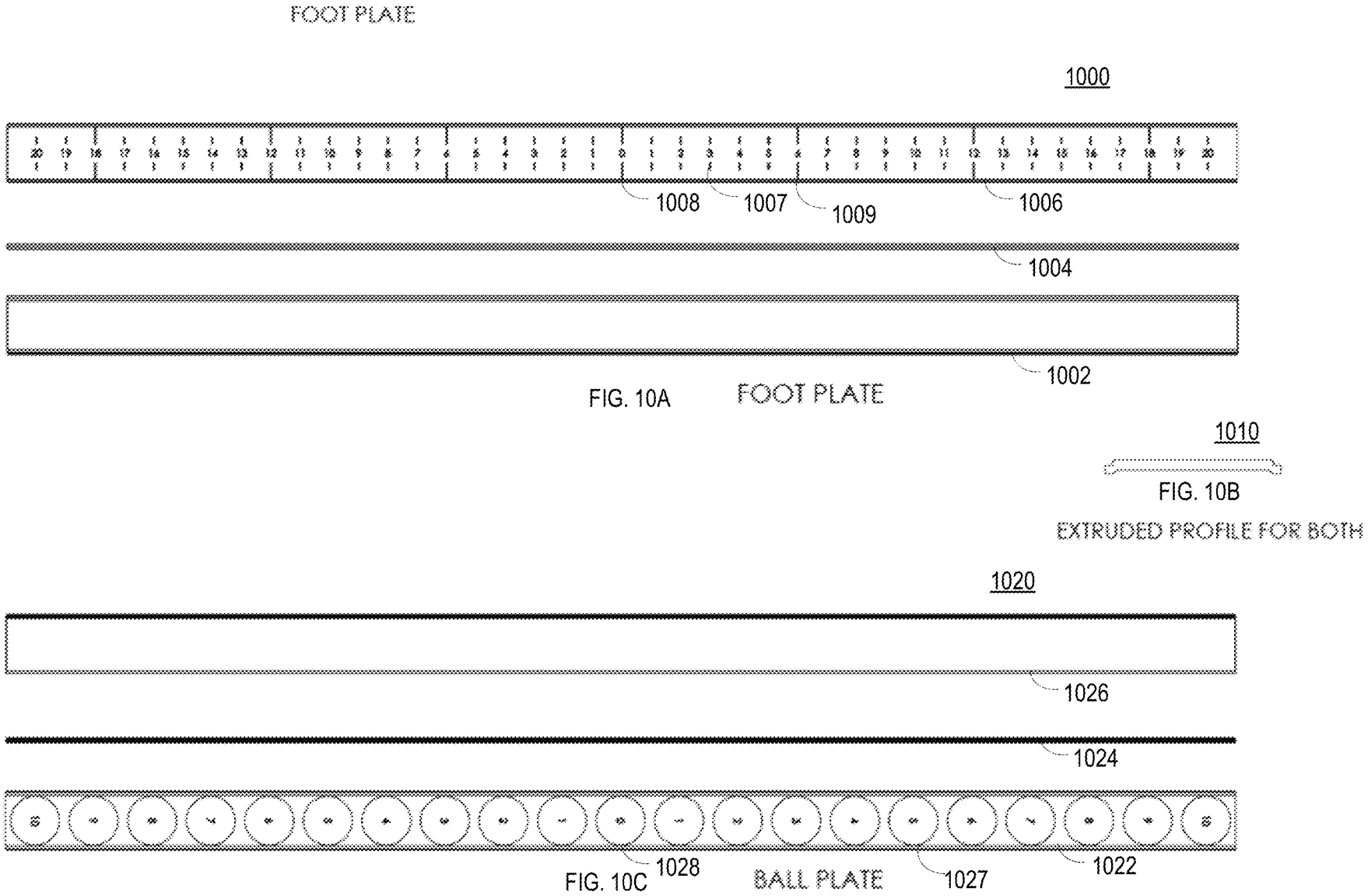
FIG. 10A depicts orthographic views including, a bottom view, a side edge view, and a top view of an exemplary embodiment of a foot plate, according to an exemplary embodiment.
FIG. 10B depicts an orthographic view of a right edge extruded end view of either the foot plate or the ball plate, according to an exemplary embodiment of the present invention.
FIG. 10C depicts orthographic views including, a top view, a side edge view, and a bottom view of an exemplary embodiment of a ball plate, according to an exemplary embodiment of the present invention.

FIG. 10A depicts orthographic views 1000 including, a bottom view 1002, a side edge view 1004, and a top view 1006, of an exemplary embodiment of a foot plate 102, with example illustrated markings including, e.g., but not limited to, an origin mark 1008, an example short marking line 1007, and example long marking line 1009, may be included, which may be laser etched onto material, such as, e.g., but not limited to, plastic, wood, aluminum (AL), or other metal, or other resilient material, and/or other material, according to an exemplary embodiment. Example foot plate marking patterns may include numbers oriented along the length for readability, or rotated 90 degrees, in other exemplary embodiments. Orientation and size of markings shown, are merely for example, and may, be alternatively made from ink, paint, etc., vs. engraving, depending on the type of material used for the various elements, according to an exemplary embodiment.

FIG. 10B depicts an orthographic view 1010 of an example right edge (or example left edge for an example symmetric embodiment) extruded end view of exemplary examples of either of the foot plate 102 or the ball plate 104, according to an exemplary embodiment of the present invention. Alternatively, in other embodiments, such plates 102, 104 may have other cross-sectional shapes including, e.g., rectangular, trapezoidal, parallelogram, etc., according to an exemplary embodiment of the present invention. Example dimensions of the example plates 102, 104 may include, e.g., but not limited to, a length of about 42 inches, approximately 1.830 inches at bottom, and approximately 2.000 inches, or 1.995-2.005 inch at top widest dimension, the overhang portions on either end may be approximately 0.081 inch in top width, sloping to a width of 0.150, and 0.085 in bottom width, with an inner thickness of the plates of about 0.119, or 0.116-0.122 inch, according to an example embodiment. All dimensions are merely for example, but not limitation.

Figure 6A:
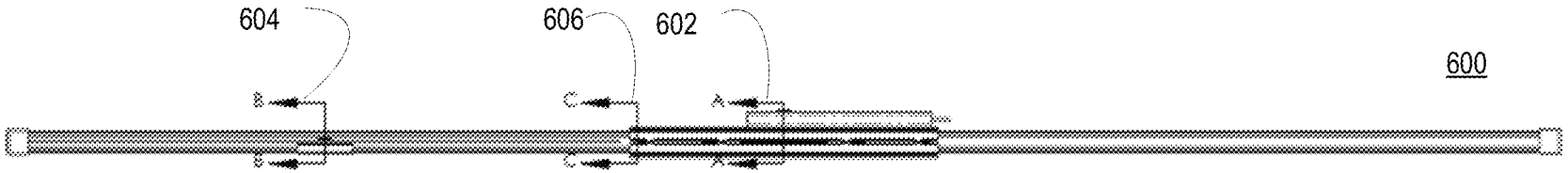
FIGS. 6A, 6B, 6C, and 6D depict a back edge view of the apparatus of FIG. 5, a cross-sectional view of section A-A, a cross-sectional view of section B-B, and a cross-sectional view of section C-C, respectively, according to an exemplary embodiment of the present invention.
Figure 6C:
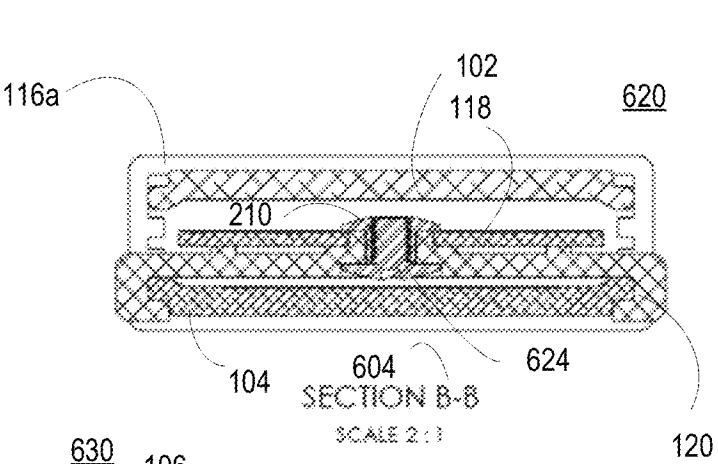
Figure 6D:
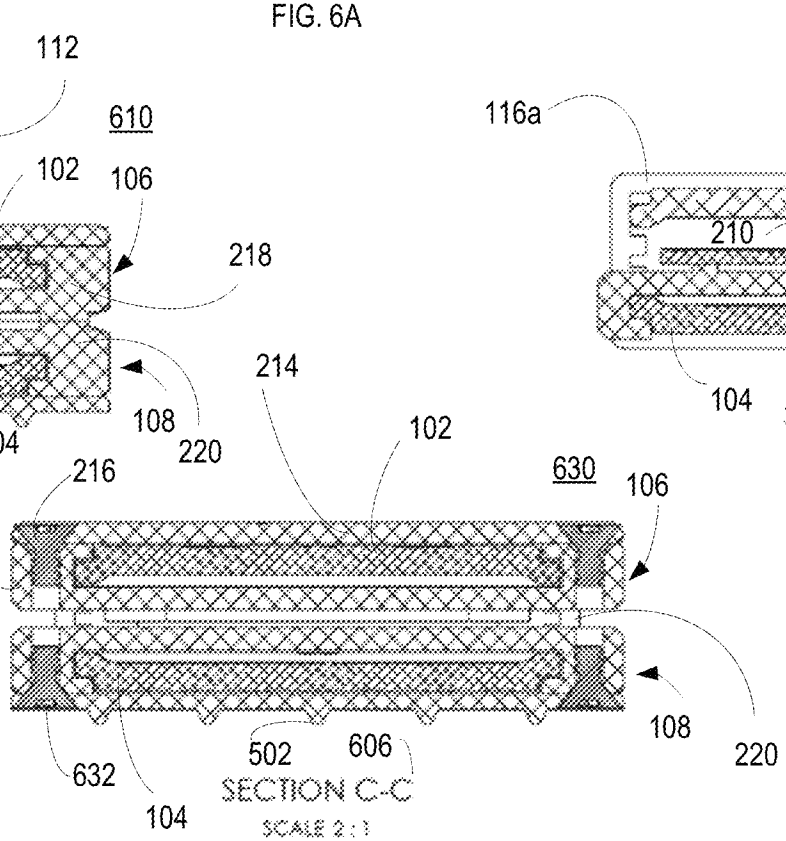
Figure 6B:
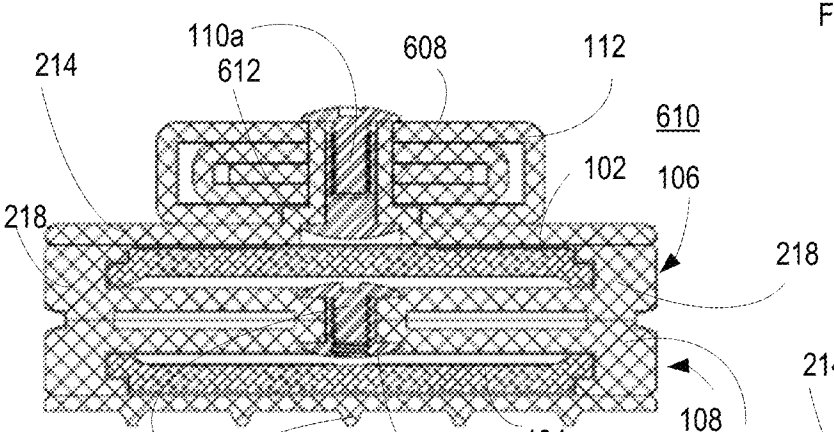

FIG. 10C depicts orthographic views 1000 including, a top view 1022, a side edge view 1024, and a bottom view 1026 of an exemplary embodiment of a ball plate 104, with illustrative ball symbols of approximately 1.67" diameter ball symbol markings, at an origin 1028, and at any of various repeated ball symbol markings 1027, separated by an example gap, and with exemplary numbering from an origin, to assist a trainee in learning to hit any type of club an ball position, according to an exemplary embodiment of the present invention. The swing plate may be a similar shape to the ball plate of FIG. 10C, but may be of shorter length than the ball plate, as shown, according to an exemplary embodiment, and may be flat in cross-section as shown in FIGS. 6C and 7, thus having a flat edge cross-section rather than that of the ball plate of FIG. 10B.

An example swing plate may be approximately 0.063 inches in flat thickness in one example embodiment. Example ball markings may be created by laser engraving, and/or other methods of engraving, e.g., but not limited to, Aluminum material, such as AL 6061-T6, with an example anodized clear finish, with example laser marking patterns, e.g., which may be as shown in FIG. 10C 1028, or may be rotated 90 degrees, for ease of site when the swing plate is oriented at 90 degrees from the foot plate, as illustrated in FIG. 3, in an exemplary embodiment. An example width of the swing plate may be approximately 1.75 inches, and each circular ball symbol marking, which may be, e.g., but not limited to, laser etched, printed, etc., may be approximately 0.875 inches in radius, in an exemplary embodiment. Example distances between the respective center points of an example origin and labeled four ball symbol markings may be approximately 8 inches, and from a center of a numbered 4 ball symbol to the other 4 ball symbol marking, opposite of the origin ball may be approximately 16 inches in distance from center to center, in an exemplary embodiment. All dimensions provided, are merely for way of example, but not limitation.

Figure 11:
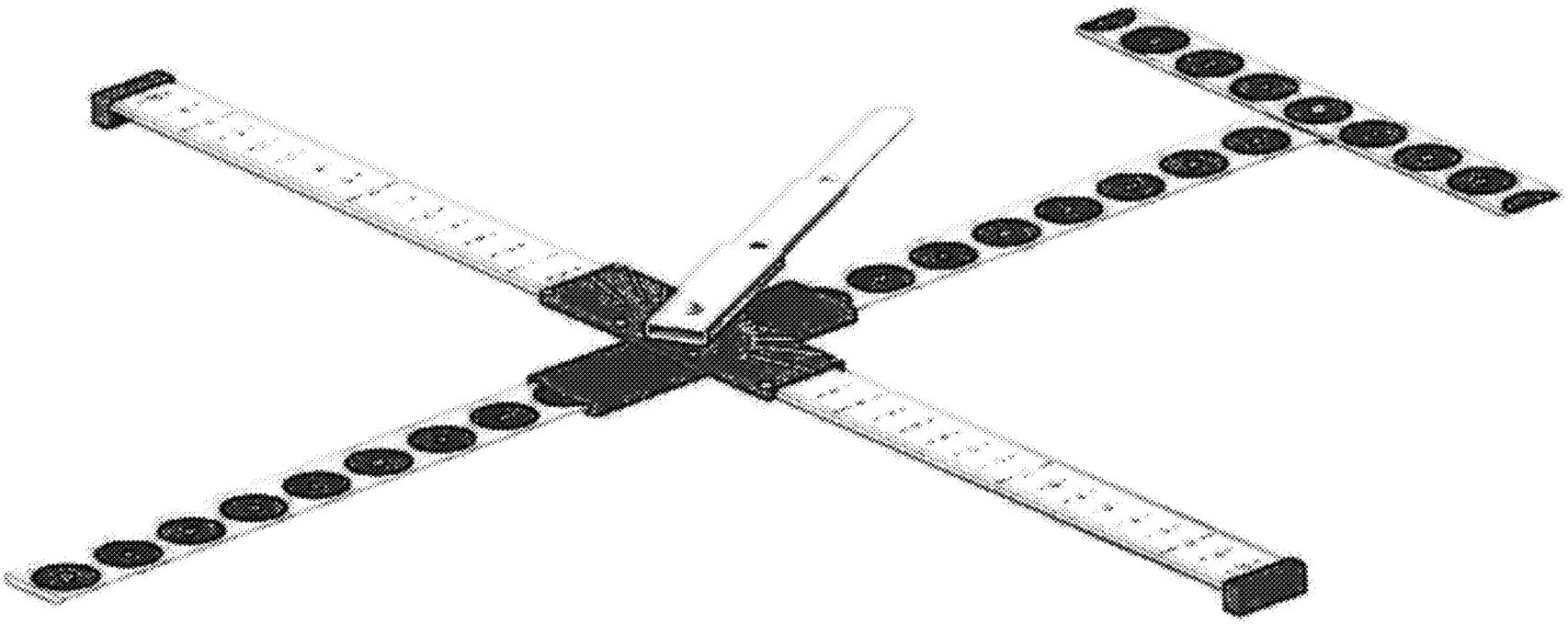
FIG. 11 depicts an exemplary 3-dimensional isometric rendering of the apparatus, according to an exemplary embodiment of the present invention.

FIG. 11 depicts a diagram 1100 illustrating an exemplary 3-dimensional isometric rendering of the apparatus, according to an exemplary embodiment of the present invention.

Figure 12:
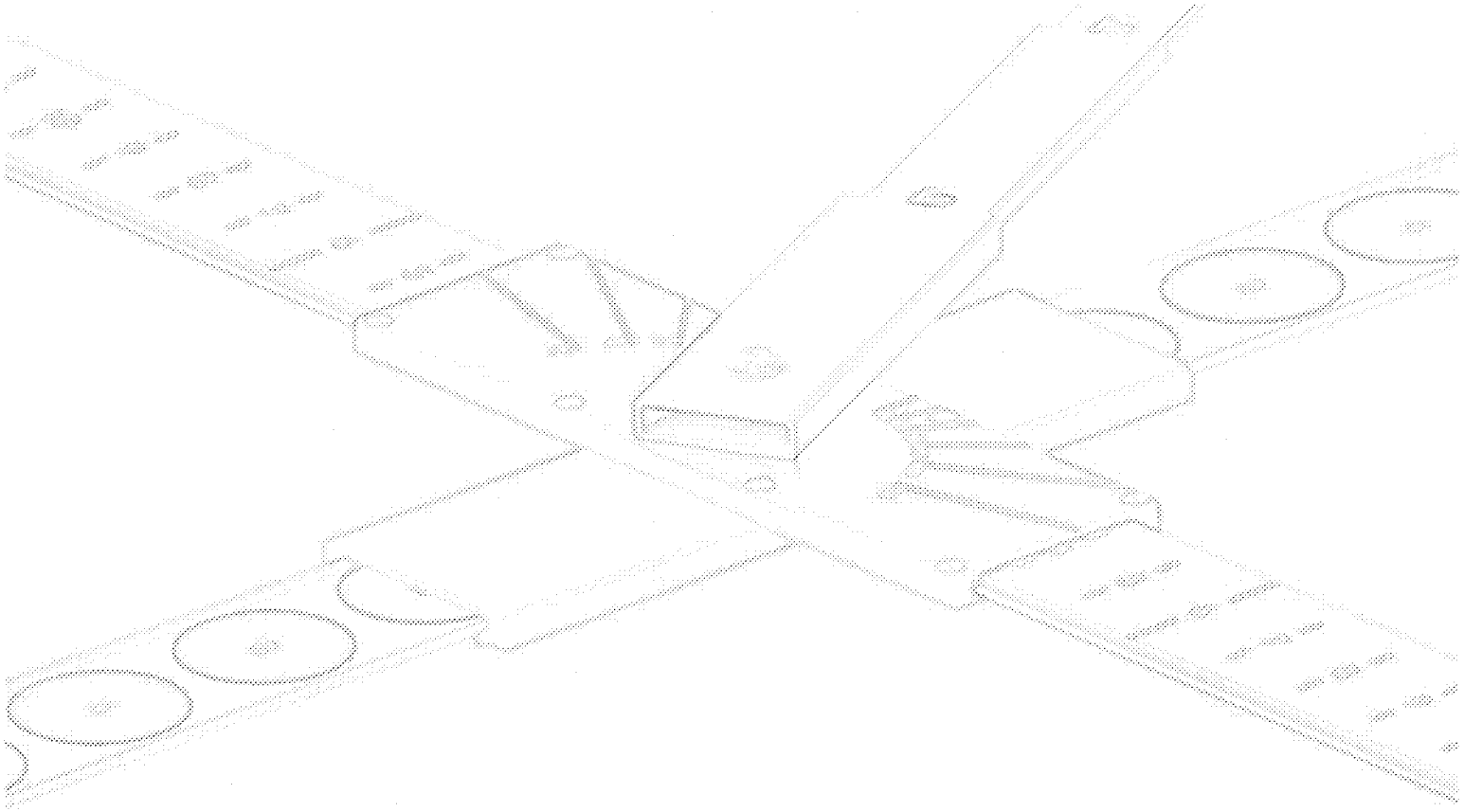
FIG. 12 depicts an exemplary 3-dimensional isometric rendering of center detail of the multiply rotatable module with exemplary telescoping member of the apparatus, with exemplary washers, screws, and the like, according to an exemplary embodiment of the present invention.

FIG. 12 depicts a diagram 1200 illustrating an exemplary 3-dimensional isometric rendering of center detail of the multiply rotatable module with exemplary telescoping member of the apparatus, with exemplary washers, screws, and the like, according to an exemplary embodiment of the present invention.

Figure 13:
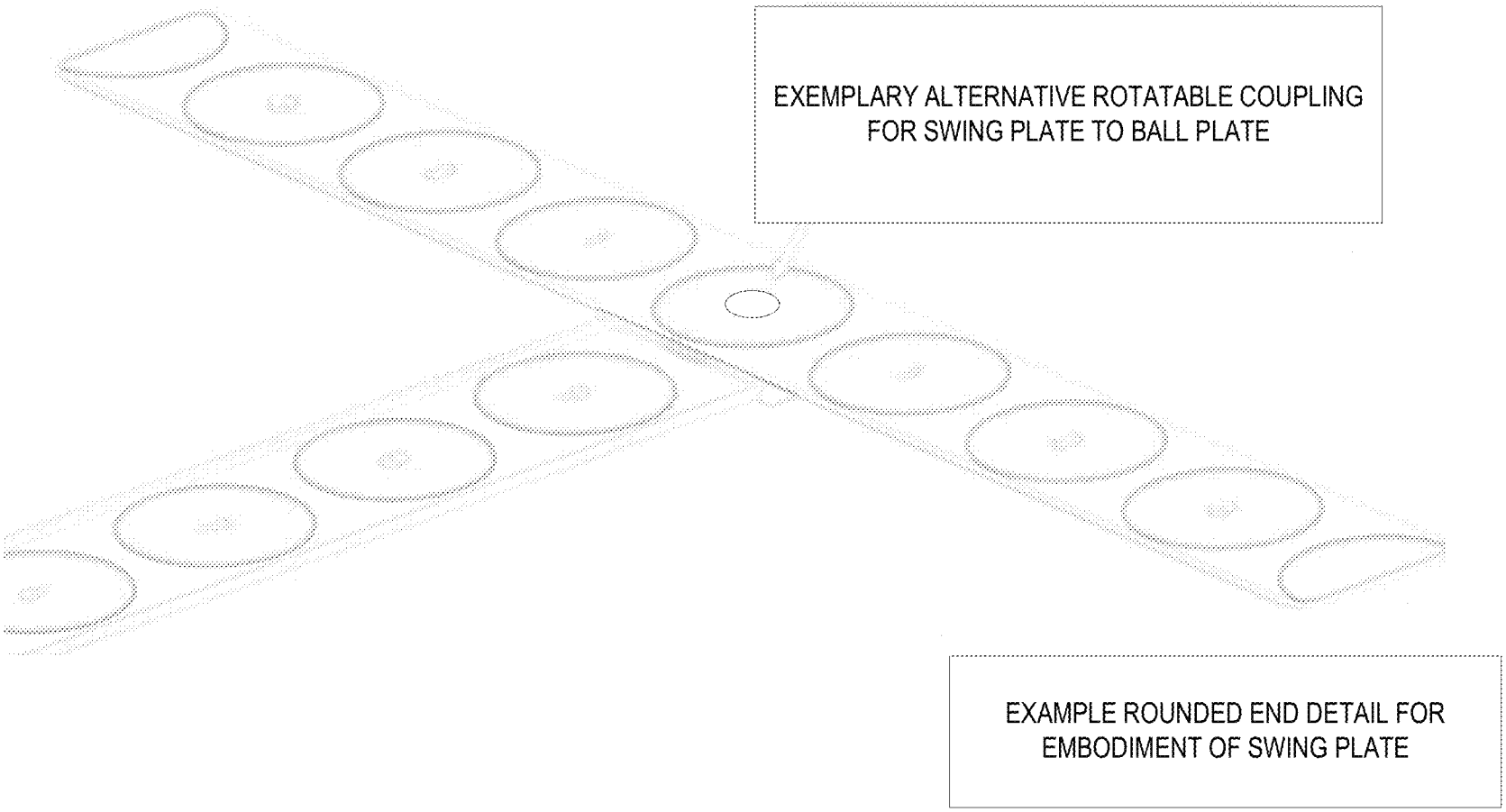
FIG. 13 depicts an exemplary 3-dimensional isometric rendering of an alternative embodiment of the swing plate coupled at an end of an exemplary embodiment of the apparatus, illustrating exemplary rounded corners, and exemplary rotated markings, on the rotatable swing plate, according to an exemplary embodiment of the present invention.

FIG. 13 depicts a diagram 1300 illustrating an exemplary 3-dimensional isometric rendering of an alternative embodiment of the swing plate coupled at an end of an exemplary embodiment of the apparatus, illustrating exemplary rounded corners, and exemplary rotated markings, on the rotatable swing plate, according to an exemplary embodiment of the present invention.

Figure 14:
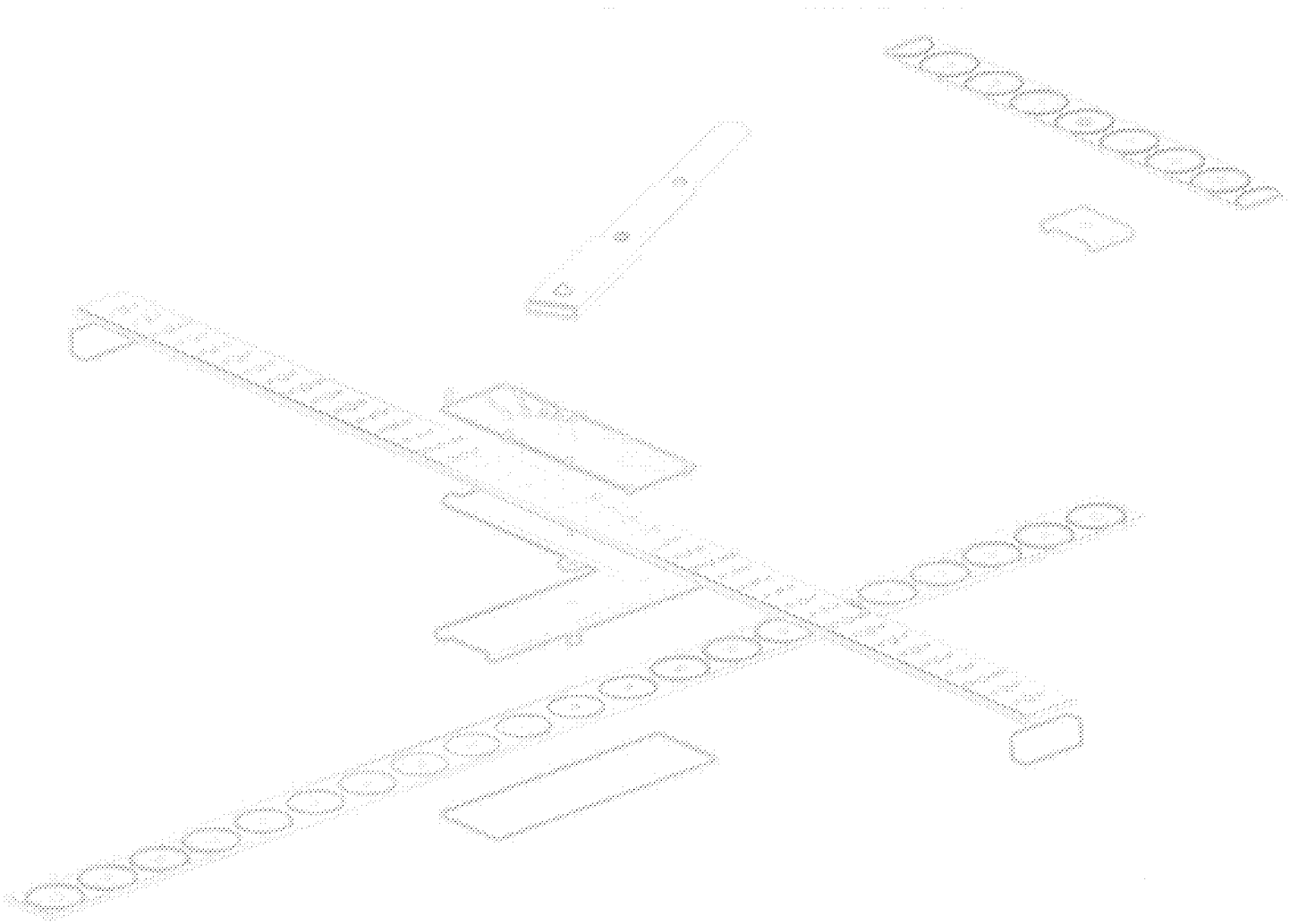
FIG. 14 depicts an exemplary 3-dimensional isometric rendering of an exploded view of an exemplary embodiment of the apparatus, according to an exemplary embodiment of the present invention.

FIG. 14 depicts a diagram 1400 illustrating an exemplary 3-dimensional isometric rendering of an exploded view of an exemplary embodiment of the apparatus, according to an exemplary embodiment of the present invention.

Figure 15:
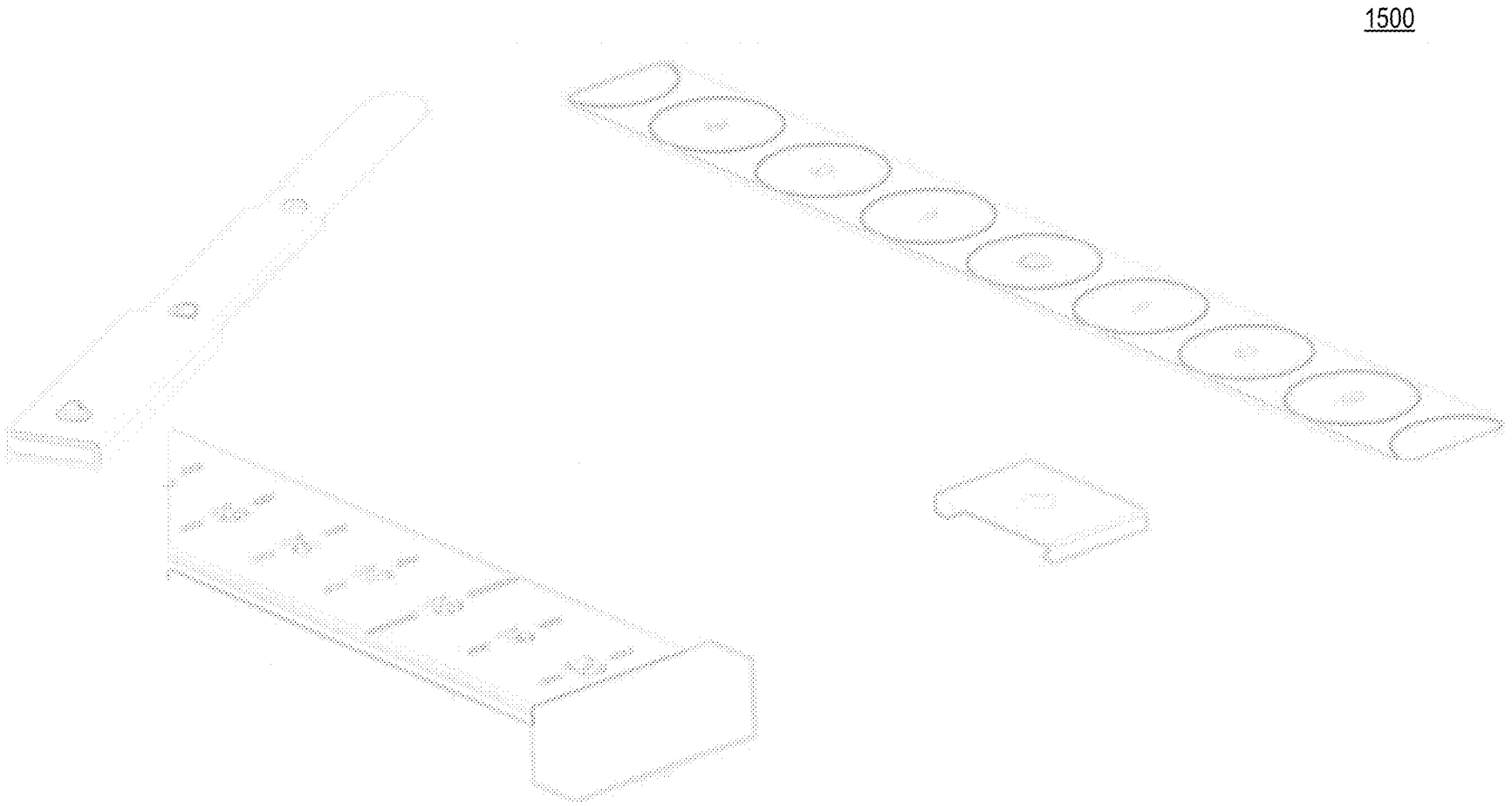
FIG. 15 depicts an exemplary 3-dimensional isometric rendering of an embodiment of the telescoping member, the swing plate, the swing slide, and the foot plate end foot of an exemplary embodiment of the apparatus, according to an exemplary embodiment of the present invention.

FIG. 15 depicts a diagram 1500 illustrating an exemplary 3-dimensional isometric rendering of an embodiment of the telescoping member, the swing plate, the swing slide, and the foot plate end foot of an exemplary embodiment of the apparatus, according to an exemplary embodiment of the present invention.

Figure 16:
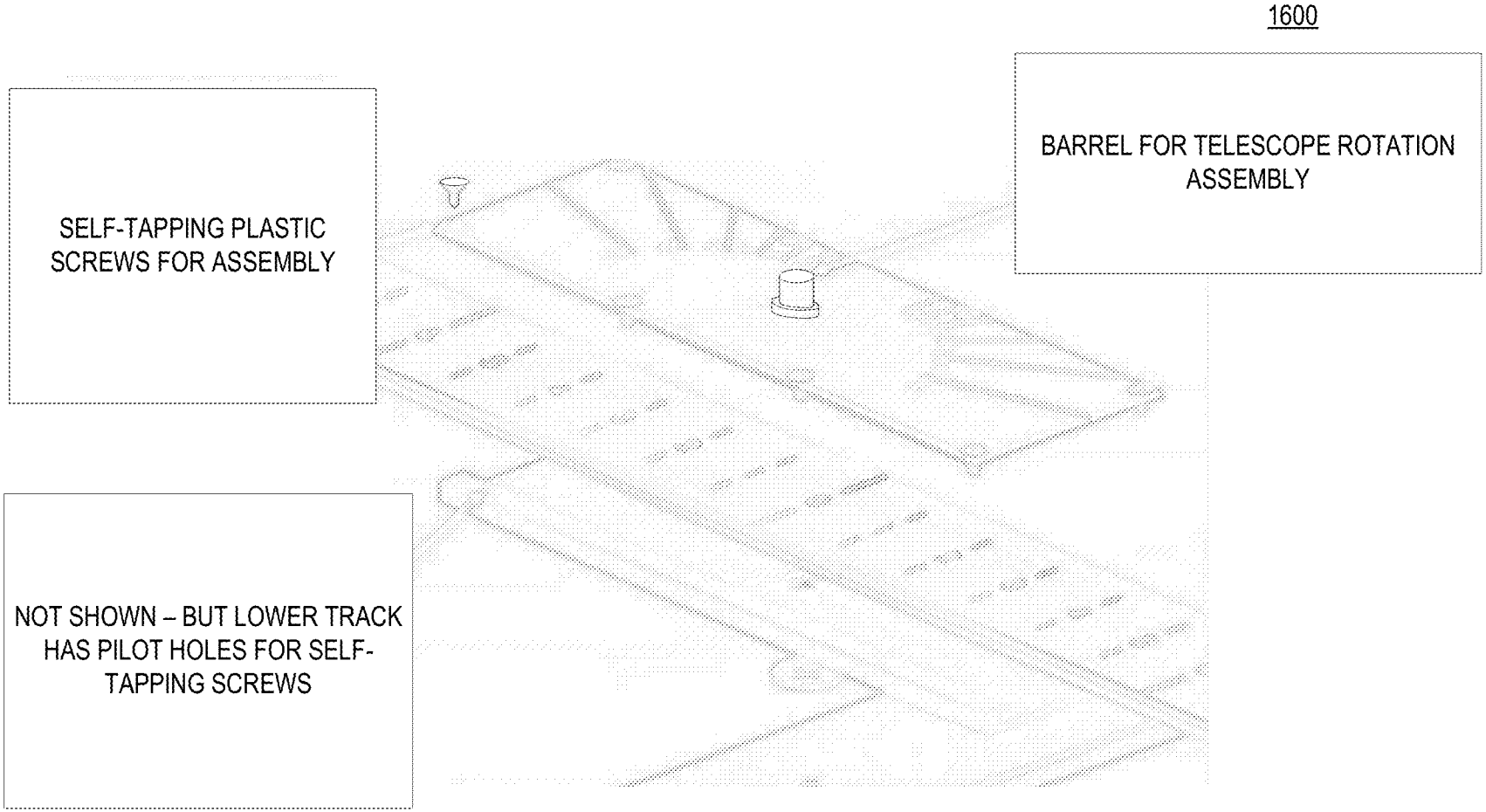
FIG. 16 depicts an exemplary 3-dimensional isometric rendering of an embodiment of the center assembly showing exemplary details of the barrel for telescope rotation assembly of the elongated member atop the example top portion of the example foot slide assembly module, the foot plate, the bottom portion of the foot slide, example screws, which may include self-tapping, and/or plastic screws, etc., example lower portion or track, which may include pilot holes, or threaded opening for screws to couple to, an exemplary washer or bushing to decrease friction and the top portion of the ball slide is partially shown, of an exemplary embodiment of the apparatus, according to an exemplary embodiment of the present invention.

FIG. 16 depicts a diagram 1600 illustrating an exemplary 3-dimensional isometric rendering of an embodiment of the center assembly showing exemplary details of the barrel for telescope rotation assembly of the elongated member atop the example top portion of the example foot slide assembly module, the foot plate, the bottom portion of the foot slide, example screws, which may include self-tapping, and/or plastic screws, etc., example lower portion or track, which may include pilot holes, or threaded opening for screws to couple to, an exemplary washer or bushing to decrease friction and the top portion of the ball slide is partially shown, of an exemplary embodiment of the apparatus, according to an exemplary embodiment of the present invention.

Figure 17:
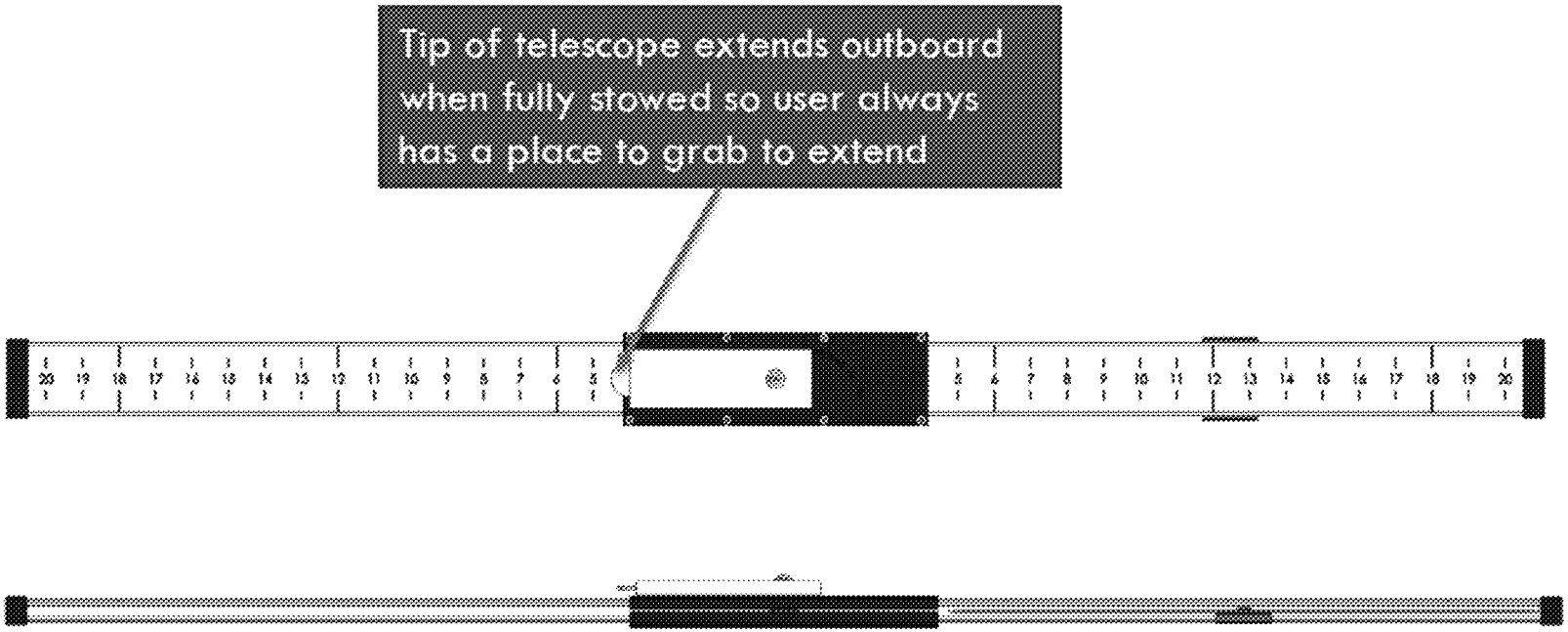
FIG. 17 depicts an exemplary 3-dimensional isometric rendering of a top and front view of the stowed version of an embodiment of the apparatus of FIG. 1, according to an exemplary embodiment of the present invention.

FIG. 17 depicts a diagram 1700 illustrating an exemplary 3-dimensional isometric rendering of a top and front view of the stowed version of an embodiment of the apparatus of FIG. 1, according to an exemplary embodiment of the present invention.

Figure 18:
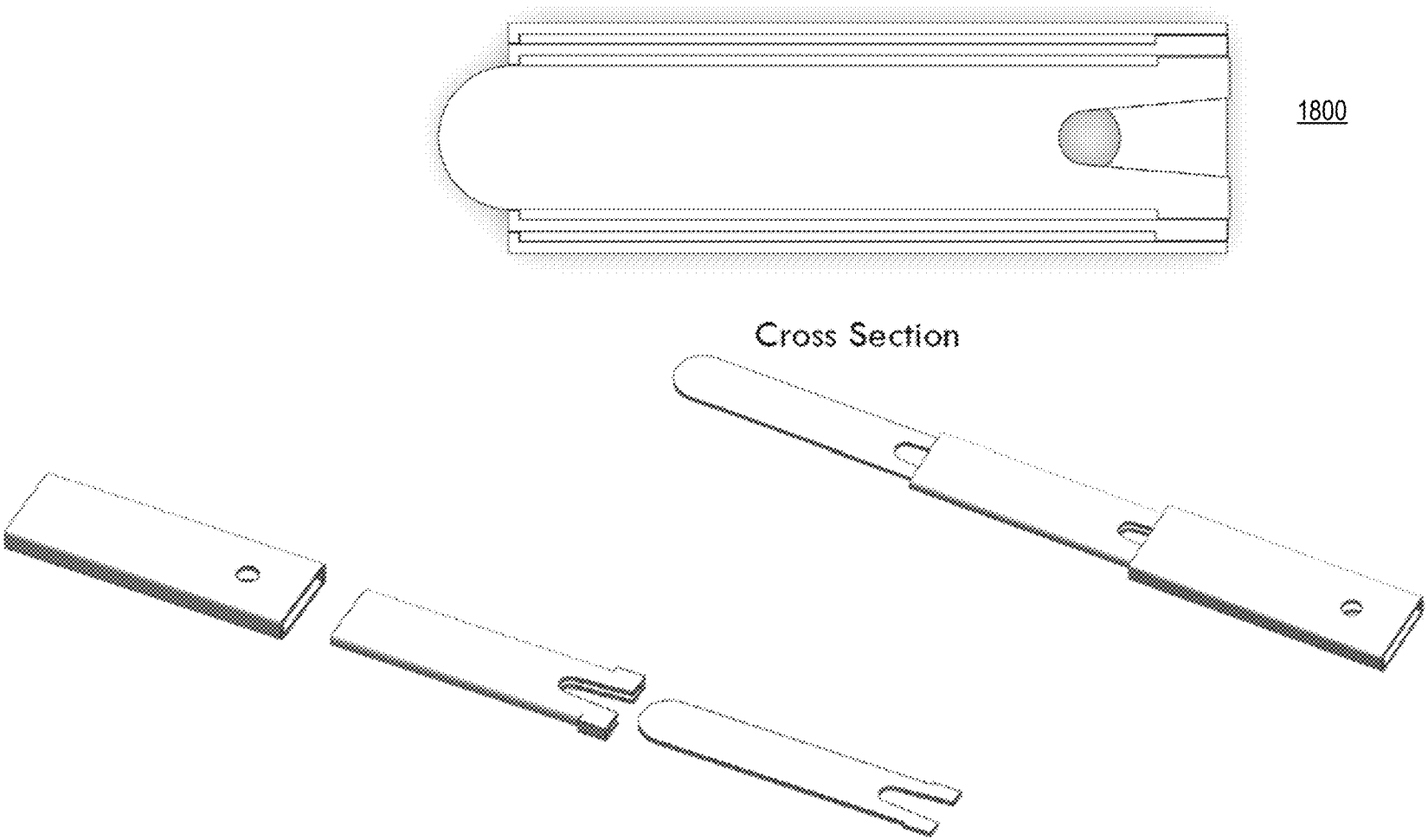
FIG. 18 depicts an exemplary 3-dimensional isometric rendering of a top collapsed and partially and fully exploded views of the exemplary 3-part telescoping member module, of an embodiment, according to an exemplary embodiment of the present invention.

FIG. 18 depicts a diagram 1800 illustrating an exemplary 3-dimensional isometric rendering of a top collapsed and partially and fully exploded views of the exemplary 3-part telescoping member module, of an embodiment, according to an exemplary embodiment of the present invention.

Figure 19:
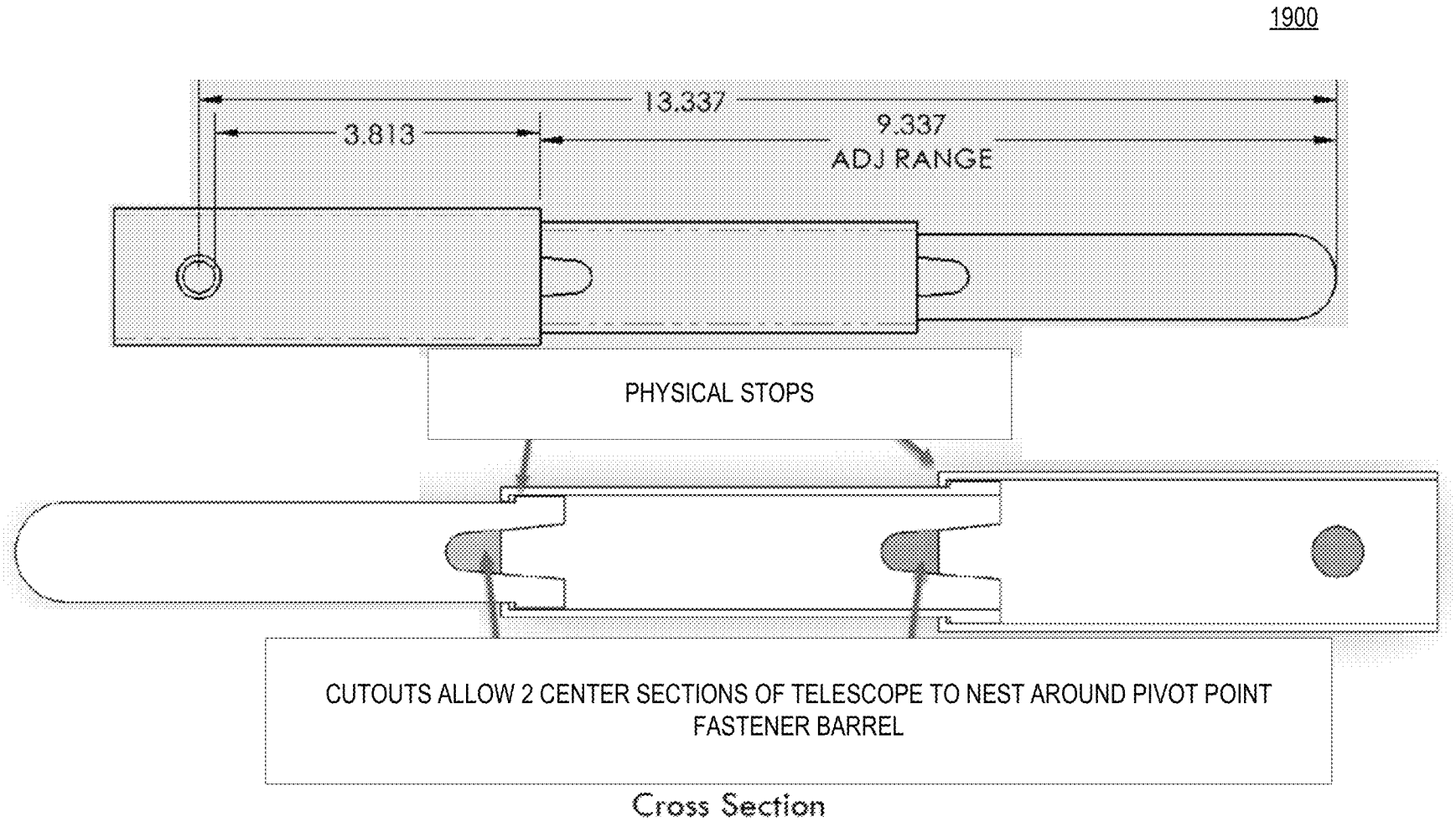
FIG. 19 depicts an exemplary 3-dimensional isometric rendering of exemplary but nonlimiting dimensions of an example of a top view of an extended exemplary embodiment of the 3-part telescoping member module, illustrating example physical stops by including example cross-sections of an embodiment, according to an exemplary embodiment of the present invention.

FIG. 19 depicts a diagram 1900 illustrating an exemplary 3-dimensional isometric rendering of exemplary but non-limiting dimensions of an example of a top view of an extended exemplary embodiment of the 3-part telescoping member module, illustrating example physical stops by including example cross-sections of an embodiment, according to an exemplary embodiment of the present invention.

Figure 20:
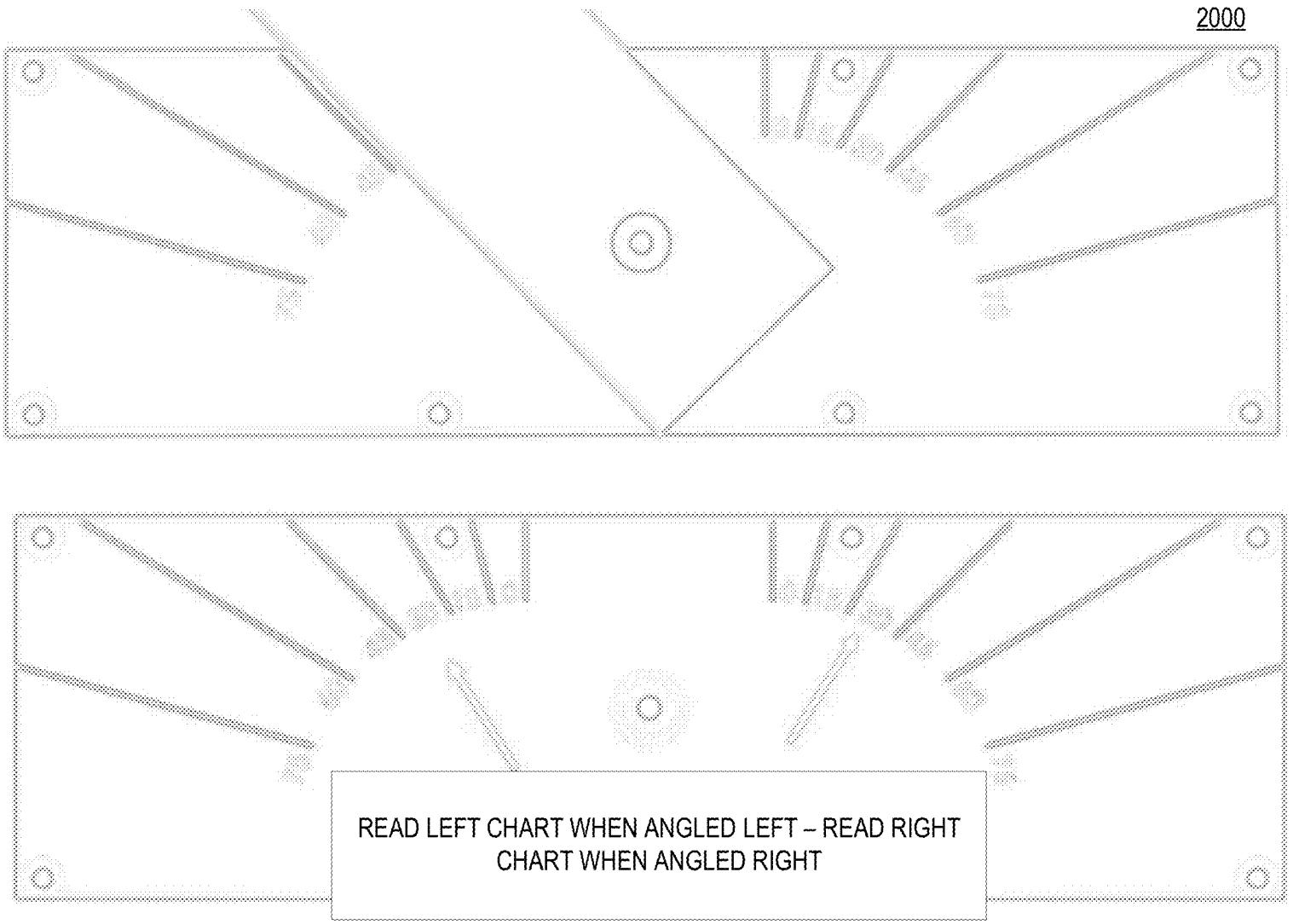
FIG. 20 depicts an exemplary 3-dimensional isometric rendering of exemplary top view of example markings on the top surface of the top portion of the foot slide, which forms an example base of the example 3 part telescoping member, and illustrating example angular protractor measurements as may be included in example embodiments, according to an exemplary embodiment of the present invention.

FIG. 20 depicts a diagram 2000 illustrating an exemplary 3-dimensional isometric rendering of exemplary top view of example markings on the top surface of the top portion of the foot slide, which forms an example base of the example 3 part telescoping member, and illustrating example angular protractor measurements as may be included in example embodiments, according to an exemplary embodiment of the present invention.

Figure 21:
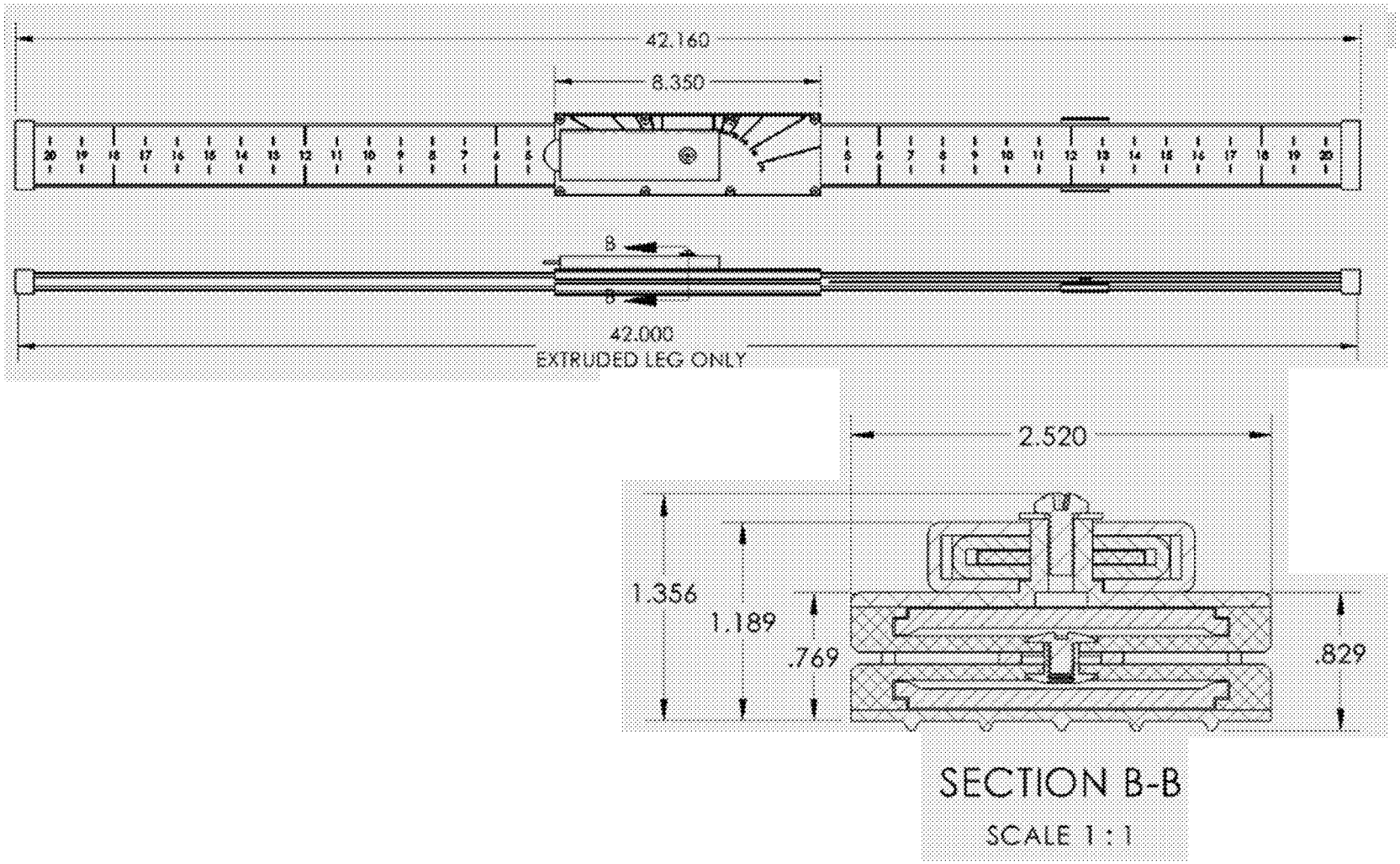
FIG. 21 depicts an exemplary top, front and cross-sectional cutaway view with exemplary but nonlimiting dimensions, according to an exemplary embodiment and illustrating an example embodiment, where a top screw is screwed into the example barrel elongated member for securing the rototable telescoping member about the base (top portion of the foot slide) to allow securing the telescoping member without need for a bottom nut, in alternative embodiments, a nut, or a rivet, or other coupler may be used to secure components together, and components of alternative dimensions may also be used, according to an exemplary embodiment of the present invention.

FIG. 21 depicts a diagram 2100 illustrating an exemplary top, front and cross-sectional cutaway view with exemplary but nonlimiting dimensions, according to an exemplary embodiment and illustrating an example embodiment, where a top screw is screwed into the example barrel elongated member for securing the rototable telescoping member about the base (top portion of the foot slide) to allow securing the telescoping member without need for a bottom nut, in alternative embodiments, a nut, or a rivet, or other coupler may be used to secure components together, and components of alternative dimensions may also be used, according to an exemplary embodiment of the present invention.

Figure 22:
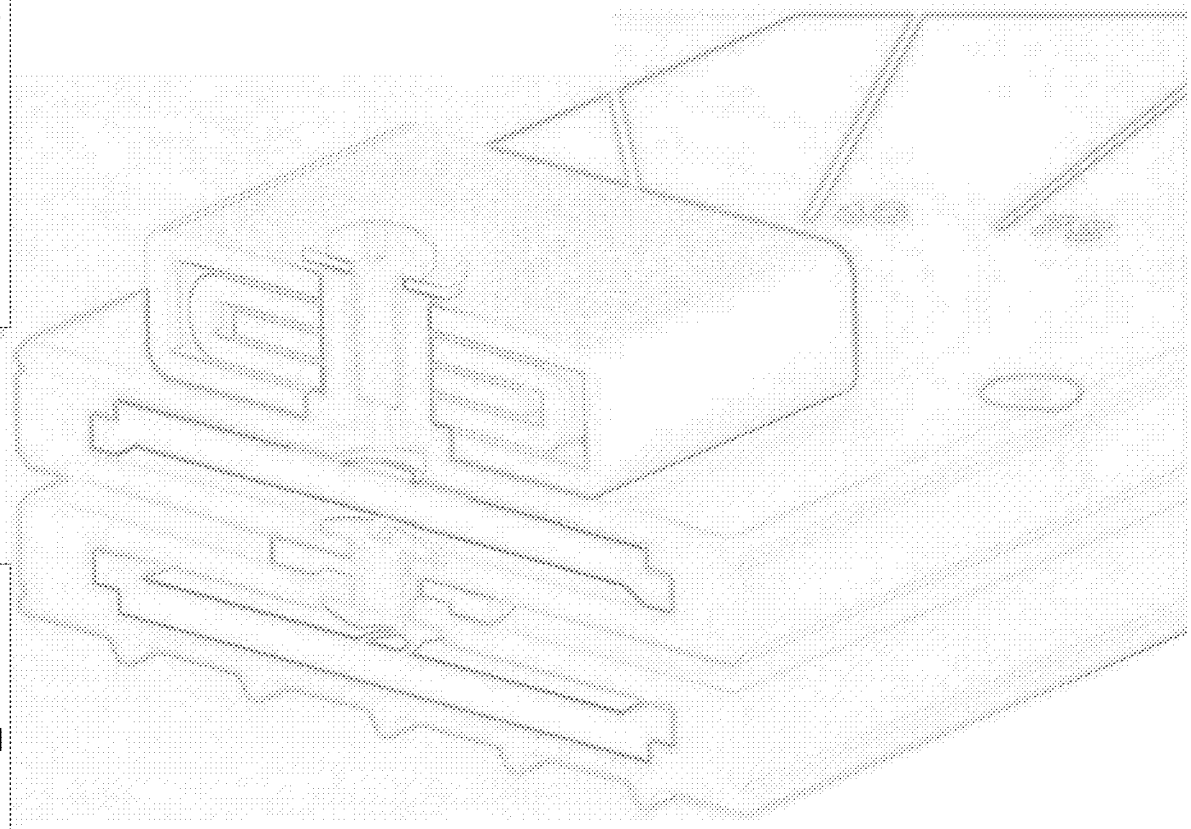
FIG. 22 depicts an exemplary 3-dimensional isometric rendering of an exemplary but nonlimiting cutaway view of the center joint, with an exemplary but non limiting barrel style fastener, or elongated portion to the base plate (top portion of the exemplary foot slide according to embodiments, and also illustrates a rendering of the cross-section of an exemplary lower portion rotatably coupling the foot slide to the ball slide, and in alternative embodiments, threading may be made into plastic, or via a nut, or by a rivet, low-profile rivet, and/or other coupling mechanism, according to an exemplary embodiment of the present invention.

FIG. 22 depicts a diagram 2200 illustrating an exemplary 3-dimensional isometric rendering of an exemplary but nonlimiting cutaway view of the center joint, with an exemplary but non limiting barrel style fastener, or elongated portion to the base plate (top portion of the exemplary foot slide according to embodiments, and also illustrates a rendering of the cross-section of an exemplary lower portion rotatably coupling the foot slide to the ball slide, and in alternative embodiments, threading may be made into plastic, or via a nut, or by a rivet, low-profile rivet, and/or other coupling mechanism, according to an exemplary embodiment of the present invention.

Figure 23:
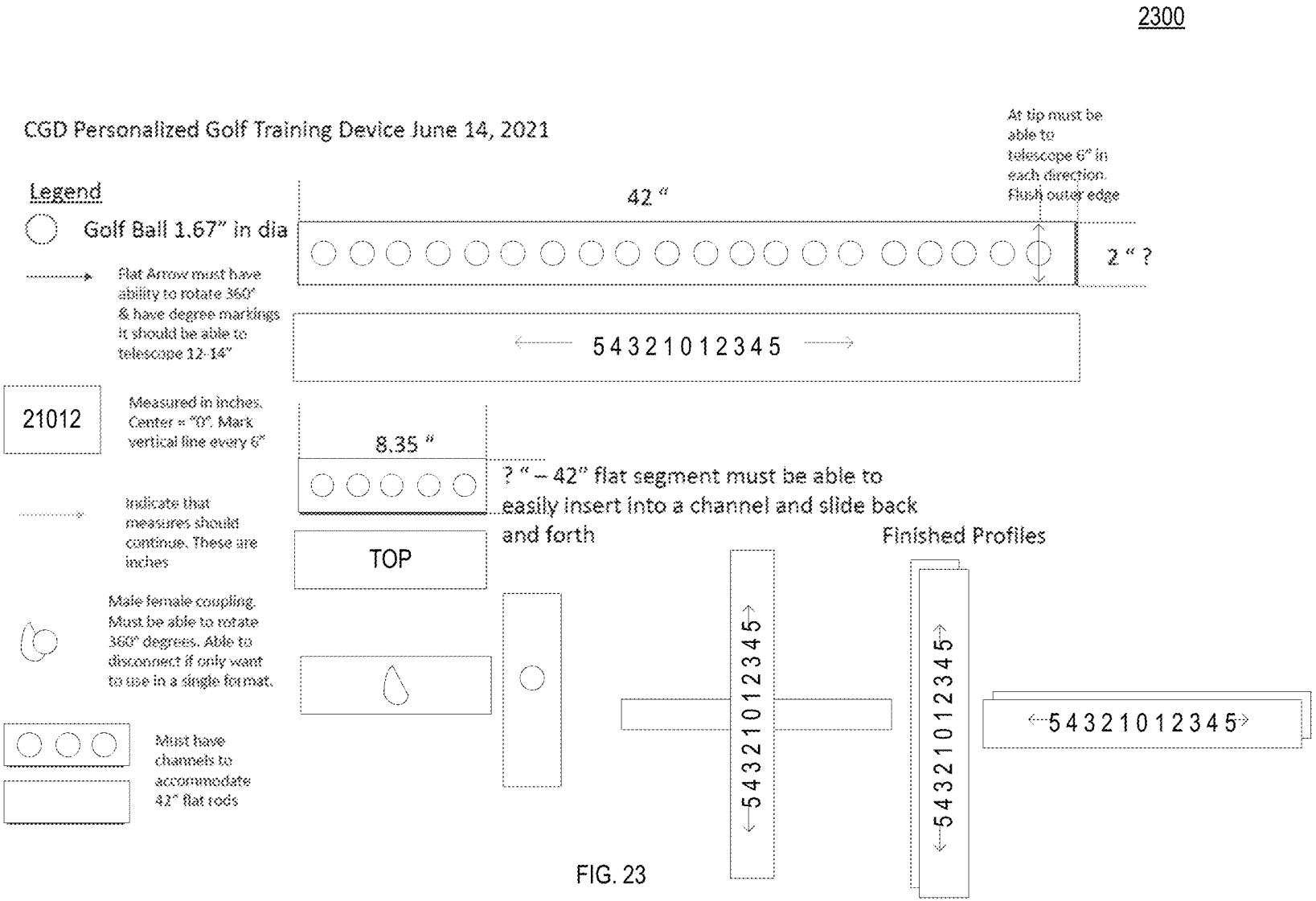
FIG. 23 depicts an exemplary embodiment of a high level pictorial representations of alternative embodiments, and description of various exemplary embodiments of the present invention.

FIG. 23 depicts a diagram 2300 illustrating an exemplary embodiment of a high level pictorial representations of alternative embodiments, and description of various exemplary embodiments of the present invention.

Figure 24:
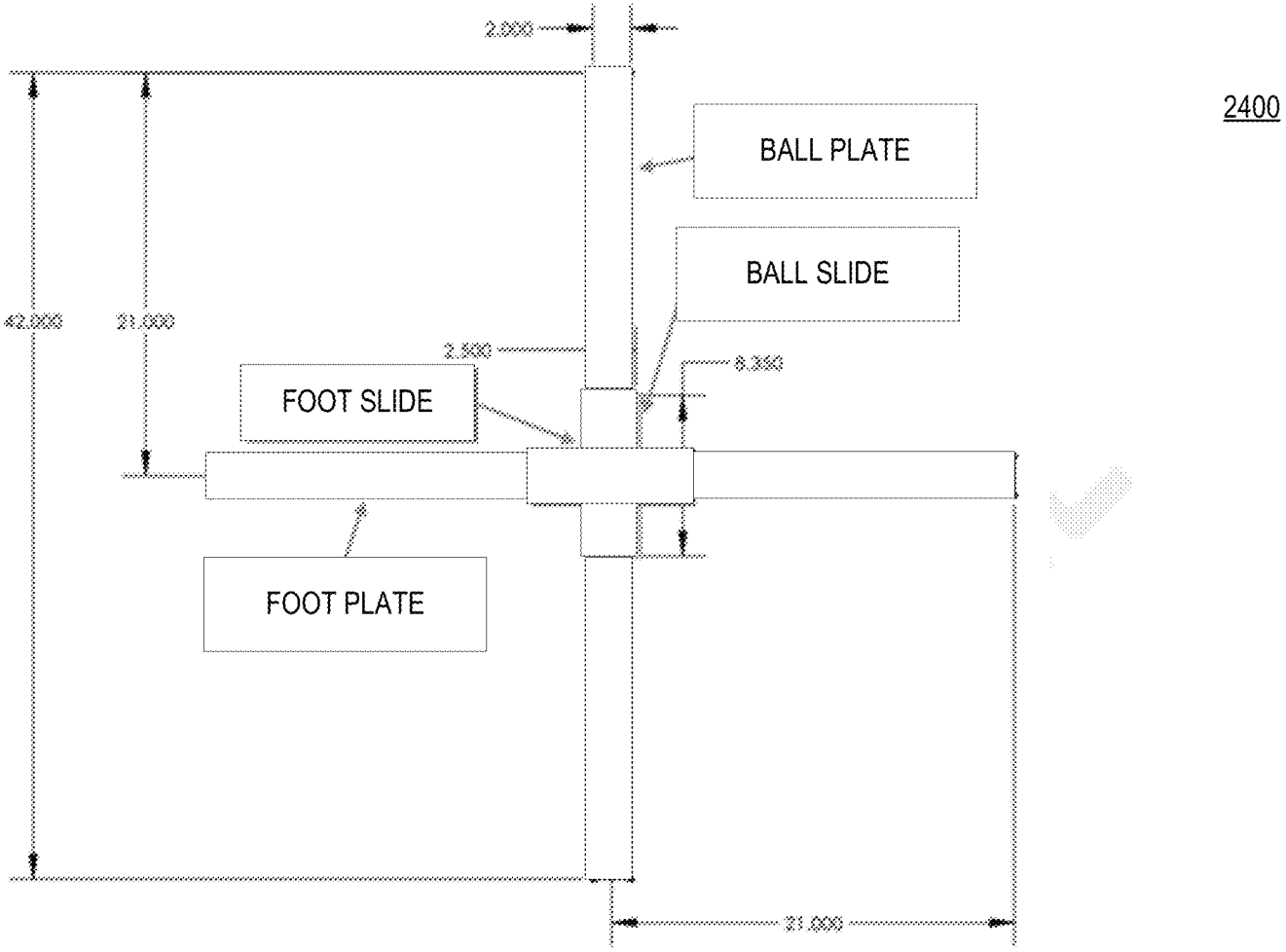
FIG. 24 depicts an exemplary simplified diagram of a sliding, rotatable component with example, but nonlimiting dimensions, according to an exemplary embodiment.

FIG. 24 depicts an exemplary simplified diagram 2400 illustrating an embodiment of a sliding, rotatable component with example, but nonlimiting dimensions, according to an exemplary embodiment.

Figure 25:
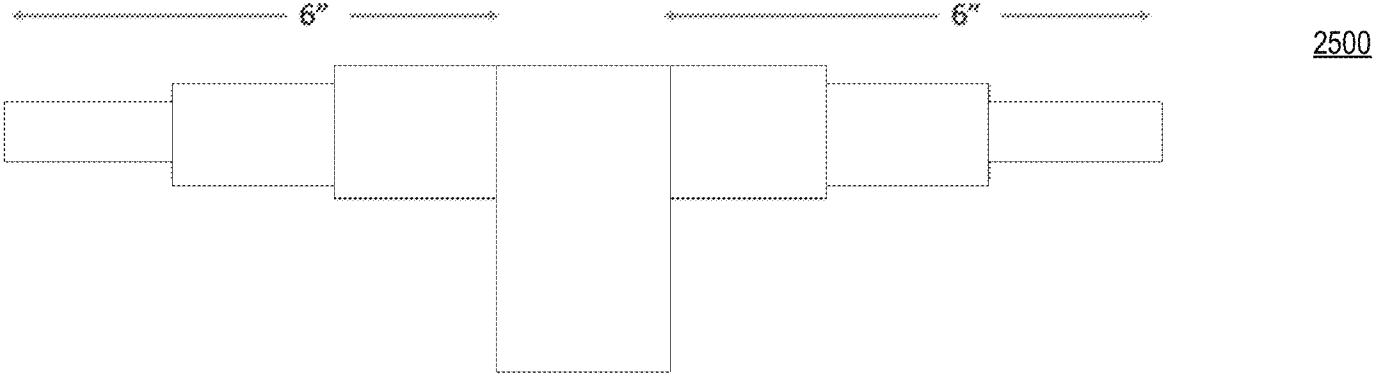
FIG. 25 depicts an exemplary simplified diagram of a telescoping member, according to an exemplary embodiment.

FIG. 25 depicts an exemplary simplified diagram 2500 of an exemplary telescoping member, according to an exemplary embodiment.

Figure 26:
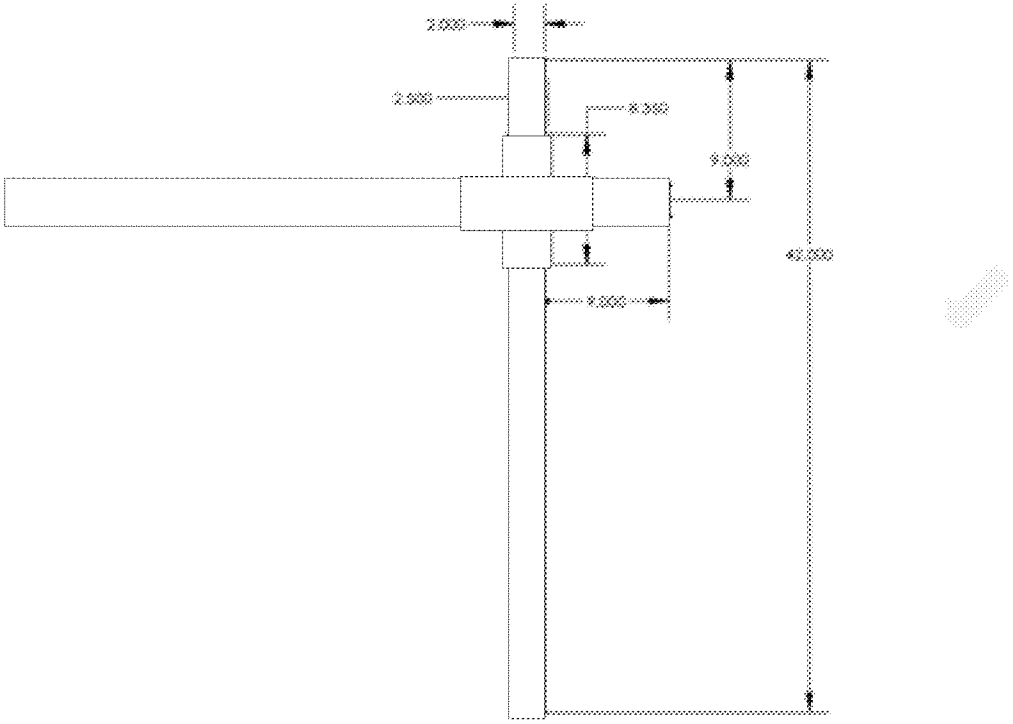
FIG. 26 depicts an exemplary diagram illustrating an exemplary maximum travel position of exemplary linear slides, according to an exemplary embodiment.

FIG. 26 depicts an exemplary diagram 2600 illustrating an exemplary maximum travel position of exemplary linear slides, according to an exemplary embodiment.

Figure 27:
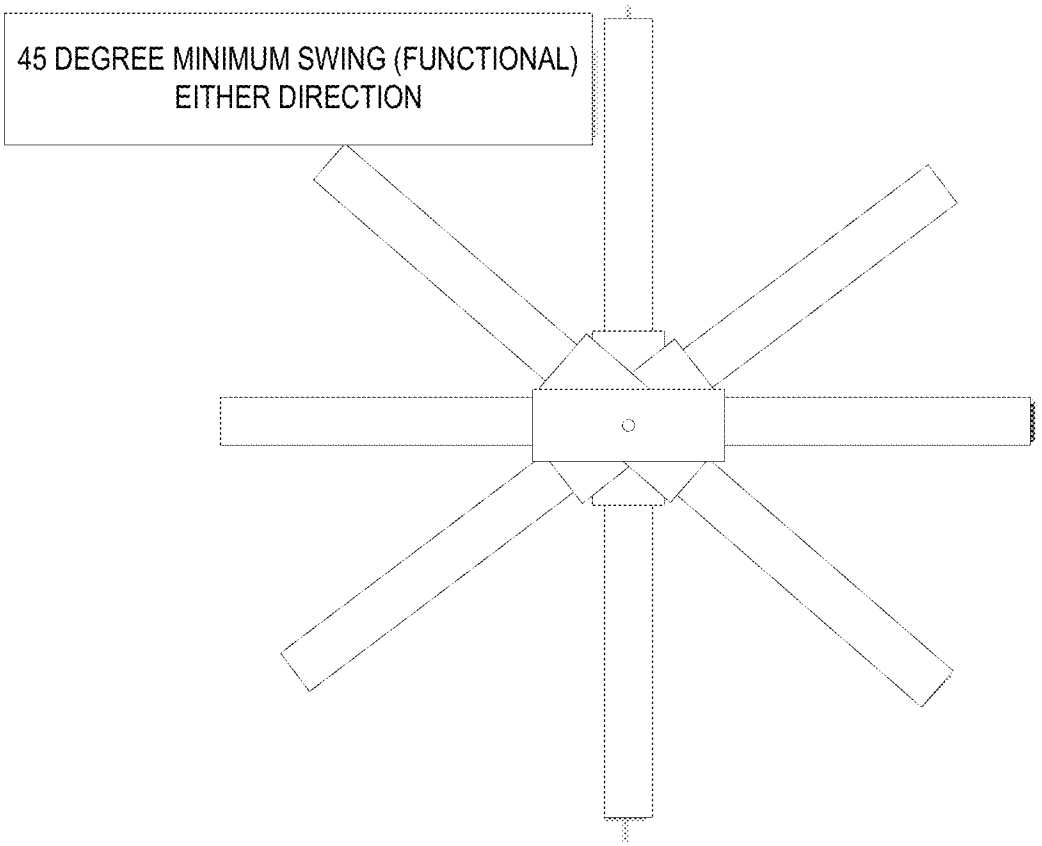
FIG. 27 depicts an exemplary diagram illustrating an exemplary functional rotational swing, according to an exemplary embodiment.

FIG. 27 depicts an exemplary diagram 2700 illustrating an exemplary functional rotational swing, according to an exemplary embodiment.

Figure 28:
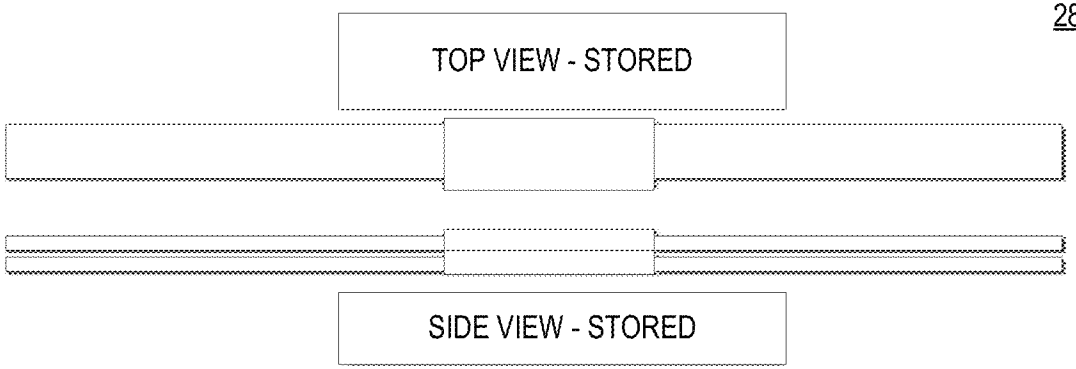
FIG. 28 depicts an exemplary diagram illustrating an exemplary stored configuration with exemplary but nonlimiting 180, etc., degrees angular swing, according to an exemplary embodiment.

FIG. 28 depicts an exemplary diagram 2800 illustrating an exemplary stored configuration with exemplary but non-limiting 180, etc., degrees angular swing, according to an exemplary embodiment.

Figure 29:
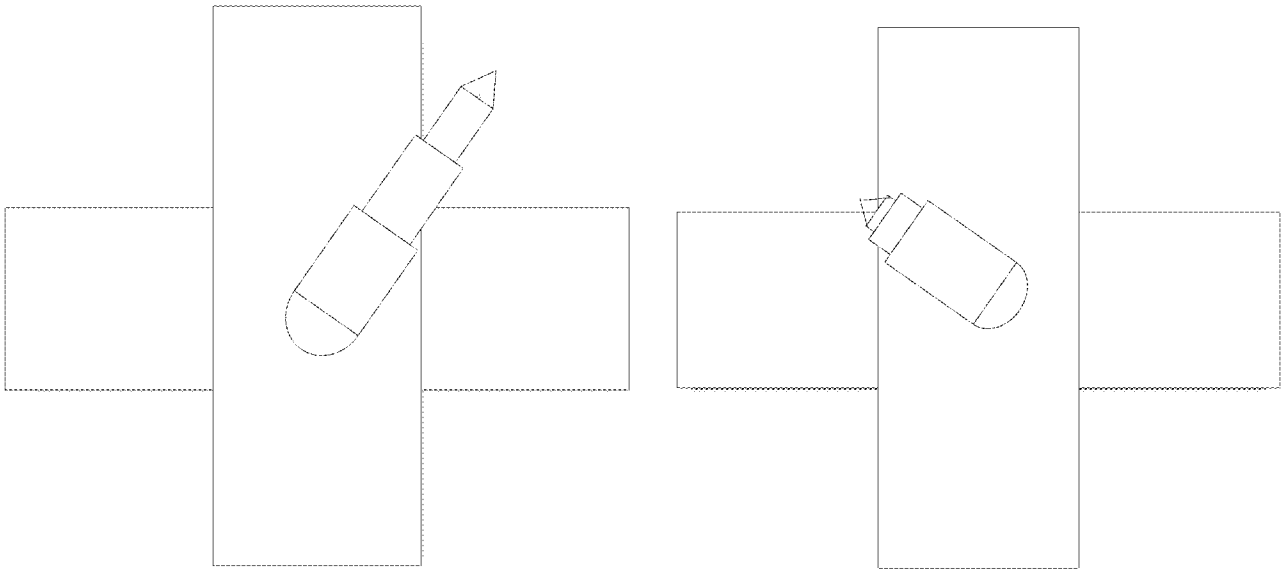
FIG. 29 depicts an exemplary diagram illustrating an exemplary telescoping angle marker, according to an exemplary embodiment.

FIG. 29 depicts an exemplary diagram 2900 illustrating an exemplary telescoping angle marker, according to an exemplary embodiment.

Figure 30:
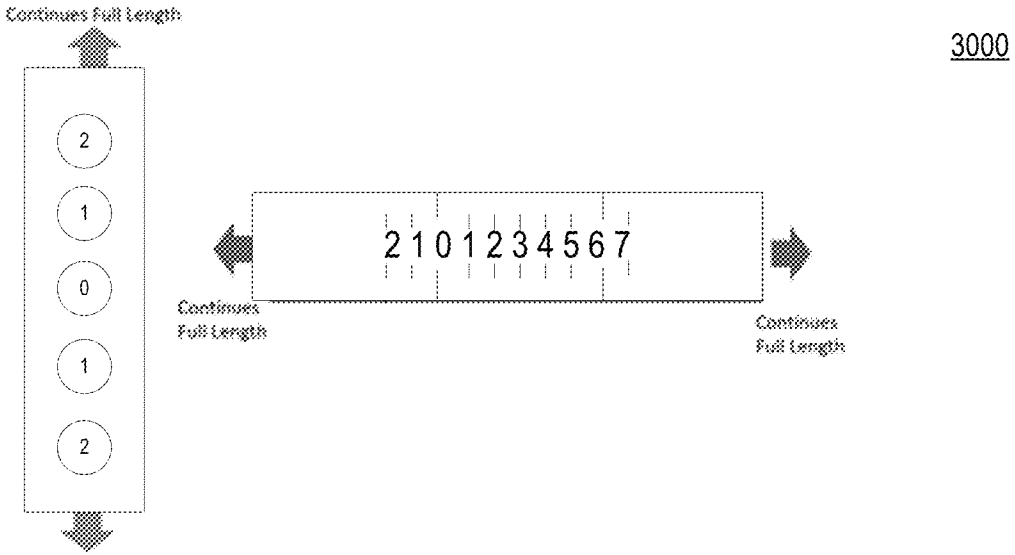
FIG. 30 depicts an exemplary diagram illustrating an exemplary marking example embodiment for exemplary ball and/or foot plates, according to an exemplary embodiment.

FIG. 30 depicts an exemplary diagram 3000 illustrating an exemplary marking example embodiment for exemplary ball and/or foot plates, according to an exemplary embodiment.

Embodiments noted above are directed to an example of a "personalized golf training device," according to various exemplary embodiments. Generally, the exemplary embodiments may be constructed of two long flat members rotating on each other about a central point," according to one exemplary embodiment. The members can be "slid" into various adjustment positions to provide the user proper special indicators for both ball and foot placement, according to one exemplary embodiment. The indicators may be numbered such that the user can repeatedly practice identical shots and optimize ball and foot placement to maximize consistency, according to one exemplary embodiment.

EXEMPLARY PRODUCT DESIGN FUNCTIONALITY SPECIFICATIONS

A. General Exemplary Functional Specifications of Exemplary Embodiments

Device may be as flat and thin as possible, according to an exemplary embodiment.

Construction may be constructed in part to be molded and/or extruded, according to an exemplary embodiment.

Material may be constructed in part by a rugged plastic, according to an exemplary embodiment.

Device may be configured for use outdoors as well as alternatively indoors in training and/or other environments, but generally may be used in a golf-course environment, according to an exemplary embodiment.

User can easily rotate and slide device into desired configuration(s), according to an exemplary embodiment Primary Device may include exemplary 4 components (See FIG. 24), according to an exemplary embodiment including, e.g., but not limited to:

Ball Plate

Long flat plate with golf ball spaced markings, according to an exemplary embodiment This component may be meant to indicate ball position, according to an exemplary embodiment.

Ball Slide

Shorter channel like component that may allows for linear motion between itself and the Ball Plate (sliding action), according to an exemplary embodiment. The Ball Plate may insert into the Ball Slide and the joint may act as a linear guide, according to an exemplary embodiment.

Foot Plate

Long flat plate with example, but not limited to, inch markings, etc. and may include other, e.g., large vertical markings every e.g., but not limited to, 6 inches, etc., according to an exemplary embodiment.

Foot Slide

Shorter channel like component that may allow for exemplary linear motion between itself and the Foot Plate (sliding action), according to an exemplary embodiment. The Foot Plate, according to an exemplary embodiment, may insert into the Foot Slide and the joint may act as a linear guide, according to an exemplary embodiment.

A secondary, telescoping function may be including in various embodiments, which may be located, e.g., but not limited to, at the tip of the Ball Plate, at the cross location of the foot slide and ball slide, coupled by a slide to another plate, or the like, according to an exemplary embodiment.

Telescoping Function (part count and design—See FIG. 25, for example), according to an exemplary embodiment./

The telescoping function may extend, e.g., but not limited to, 6", etc., in one, and/or either direction, may be, e.g., but not limited to, perpendicular to the Ball Plate, and/or at another angle to the ball plate, e.g., any 360 degree, and/or other, angled position, etc. according to an exemplary embodiment. The telescoping member, according to an exemplary embodiment, may collapse (telescope) on itself such that an associated storage profile of the assembly/module, and the device does not exceed the width of the ball plate, according to an exemplary embodiment.

Another secondary function may include a telescoping angle guide, which may be included at the center connection point, according to an exemplary embodiment.

Telescoping Function located at center of rotation on top of Foot Slide (see FIG. 29), according to an exemplary embodiment.

Ideally the telescope may extend outward, e.g., but not limited to, 18-24", 13 inches, 14 inches, 13.337 inches, etc., but realistically the length may be less, according to an exemplary embodiment.

The telescoping member may be able to rotate and indicate angles of e.g., but not limited to, +/−45 degrees, and/or in 15 degree increments, 0, 15, 30, 45, 60, 75, 90, etc., from center, in either direction, etc., according to an exemplary embodiment.

Angle Measurement marks may exist in exemplary but non-limiting 15 degree increments, 0, 15, 30, 45, 60, 75, 90, etc., according to an exemplary embodiment.

B. Exemplary Interface and/or Exemplary Motion Functionality of Exemplary Embodiments Linear motion may include, e.g., but not limited to, be provided, between Ball Plate and Ball Slide (see FIG. 26), according to an exemplary embodiment.

Travel may include, e.g., but not limited to, be +/−12", etc., from an origin and/or a neutral position, according to an exemplary embodiment.

Linear motion between Foot Plate and Foot Slide (see FIG. 26), according to an exemplary embodiment Travel may include, e.g., but not limited to, be +/−12", etc., from an origin and/or a neutral position, according to an exemplary embodiment.

Rotational Motion include, e.g., but not limited to, between Ball Slide and Ball Plate (see FIG. 27), according to an exemplary embodiment The rotational motion may include, e.g., but not limited to, support 180, etc., degree swing (in either direction and/or in one or another direction) for storage (see FIG. 28), according to an exemplary embodiment.

The rotational motion may include, e.g., but not limited to, support an exemplary, e.g., minimum of +/−45, etc., degrees swing for functional use (see FIG. 27), according to an exemplary embodiment.

Note: The difference in swing may be utilized in some manner for supporting the components above ground, according to an exemplary embodiment.

The rotation point may include, e.g., but not limited to, to be at, e.g., but not limited to, the geometric center of, e.g., but not limited to, one and/or both Ball Slide and Foot Slide, etc., according to an exemplary embodiment.

C. Exemplary Marking Functionality of Exemplary Embodiments

One, two, and/or all of the exemplary Ball Plate, and/or Foot Plate and/or swing plate, may have, e.g., but not limited to, specific marking such as, e.g., but not limited to, printed text, lettering, numbering, alphanumeric, and/or symbolic, and/or image, icon, emoji, or the like, whether printed, imprinted, emprinted, embossed, raised, embedded, adhered, bonded, engraved, etched, laser engraved, laser etched, 3D printed, formed by additive or subtractive manufacturing, CNC, etc, and/or other form of marking, engraving, etc., as will be apparent to those skilled in the relevant art, etc., according to an exemplary embodiment. Exemplary images and/or symbols may also or alternatively be included, including, e.g., but not limited to, symbols and/or images of a golf ball, a trademark, a golf related brand, and/or logo design and/or trademark, and/or other indicia representative of an associated source and/or branded or white labeled, original equipment manufactured (OEM'ed), customized, branded with name, image, likeness (NIL) of an example sports pro, professional golfer, or the like, version(s) of the product, according to various exemplary embodiments.

The exemplary Ball Plate may have exemplary round marking features, and/or images of golf balls, or the like, and/or other symbol or geometric shape, etc., e.g., but not limited to, spaced by an exemplary diameter of a golf ball and/or plus a 0.33" gap (2.0" total center to center spacing with 1.67" ball representation). Each round similar approximate size shape and/or marking, and/or such marking may be slightly smaller than the spacing for a small gap to exist between each ball marker. These markings may start at the center of the Ball Plate and may extend the full length in either and/or both directions, according to an exemplary embodiment. Each ball marking may include, e.g., but not limited to, a number and/or letter and/or other designation, icon, and/or identifier, for ease of use, such as, e.g., but not limited to, starting at 0, at an origin, like an exemplary number line, or the like, and may, e.g., but not limited to, increment, e.g., by 1 in either and/or one, or both direction(s), etc., according to an exemplary embodiment.

The exemplary Foot Plate may include, e.g., but not limited to, have a ruler-like marking structure, with an exemplary zero indicator at one end, and/or at an origin, and/or center position, and exemplary marks may emanate in one and/or both and/or in either direction with, e.g., but not limited to, one or more ticks, which may include one or more line symbols, which may be of uniform or different lengths, etc., according to one exemplary embodiment. For example, exemplary tick marks may include, e.g., but not limited to, be shown every 1 inch, with corresponding number label markings, according to one exemplary embodiment. The Tick marks may also include slightly longer tick marks at certain thresholds, say, e.g., but not limited to, at every 6", 5", 10", 12" or the like, etc., the ticks may include an exemplary longer line than the interstitial normal tick line lengths, according to an exemplary embodiment, and/or may thus by being, e.g., longer, and/or bold, and/or colored differently, etc., may stand out to the user, according to one exemplary embodiment.

Uses of conjunction language such as the word or, and/or, and, and the like, are intended herein to include the logical or interpretation, rather than an exclusive or interpretation. Thus, any use of or, can mean either alternative individually, and/or both alternatives. Further, where a plurality of alternatives are listed, any one or more of the alternatives can be considered, thus if a list of five alternatives are listed, any one or more, or combinations of any of the five alternatives, including all five alternatives, can also be considered within the scope of protection.

All examples and conditional language recited herein are intended for pedagogical purposes to aid the reader in understanding the principles of the disclosure and the concepts contributed by the inventor to furthering the art, and are to be construed as being without limitation to such specifically recited examples and conditions. Moreover, all statements herein reciting principles, aspects, and embodiments, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

What is claimed is:

1. A golf training apparatus device comprising:

a first ball plate of rectangular dimensions including a plurality of golf ball markings on a substantially flat surface;

a ball slide of rectangular dimensions including a first channel configured to slideably receive said first ball plate as a linear guide and configured to enable linear sliding motion of said first ball plate relative to said ball slide in said first channel;

a foot plate of rectangular dimensions; and a foot slide of rectangular dimensions including a second channel configured to slideably receive said foot plate as a linear guide and configured to enable linear sliding motion of said foot plate relative to said foot slide in said second channel, wherein said foot slide is coupled to said ball slide; and wherein said foot slide coupled to said first ball slide comprises at least one or more of:

wherein said foot slide is coupled via at least one axle to said ball slide to enable rotation relative to one another;

wherein said foot slide is coupled to said ball slide to enable angular rotation of said foot slide relative to said ball slide;

wherein said foot slide is coupled at a center point of said foot slide via at least one axle to a center point of said ball slide to enable angular rotation of said foot slide relative to said ball slide;

wherein said foot slide is coupled at a center point of said foot slide to a center point of said ball slide to enable angular rotation of up to 180 degrees of said foot slide relative to said ball slide;

wherein said foot slide is coupled at a center point of said foot slide to a center point of said ball slide to enable angular rotation of up to 360 degrees of said foot slide relative to said ball slide;

wherein said foot slide is coupled at a center point of said foot slide to a center point of said ball slide to enable angular rotation of 45 degrees of said foot slide relative to said ball slide; or wherein said foot slide and said ball slide are coupled to one another rotatably, by at least one axle passing through an opening in each of said foot slide and said ball slide, and wherein said at least one axle comprises at least one or more of a screw, a nut, a barrel, a rivet, an annular member, or a washer.

2. The golf training apparatus device according to claim 1, wherein said first ball plate comprises at least one or more of:

wherein said plurality of golf ball markings each comprise at least one or more of:

a circular feature marking;

a circular etched marking;

a circular engraved marking;

a circular printed marking;

a circular embossed marking;

a circular imprinted marking;

a circular raised marking;

a circular marking of about 1.7 inches in diameter;

a series of circular markings separated by a small gap;

a series of circular marks separated by a fraction of one inch gap;

a circular feature, each of said circular features comprising a 1.67 inches in diameter circle; or a circular feature, each of said circular features comprising a 1.67 inches in diameter circle;

wherein an adjacent pair of said plurality of said golf ball markings are separated by a distance of 2 inches between centers of said adjacent pair of said plurality of said golf ball markings;

wherein said first ball plate comprises a lower surface comprising at least one lower appendage; or wherein said first ball plate comprises a lower surface comprising at least five lower appendages configured to provide frictional grip to the ground.

3. The golf training apparatus device according to claim 1, wherein said footplate resembles a ruler, on a flat surface of said footplate.

4. The golf training apparatus device according to claim 3, wherein said foot plate includes at least one or more of:

a plurality of tick short line symbol markings every inch;

a plurality of tick short line symbol markings and a longer tick line symbol marking for every six (6) inch;

a plurality of short tick line symbol markings and a plurality of long tick line symbol markings;

a plurality of equally spaced labels and tick line symbol markings; or a plurality of numeric labels.

5. The golf training apparatus device according to claim 3, wherein said foot plate comprises at least one or more of: a timeline visual representation or a number line visual representation, with an origin and numeric labels emanating in two directions.

6. The golf training apparatus device according to claim 5, wherein said foot plate comprises said timeline visual representation or said number line visual representation, with an origin marking of said origin, wherein said origin is at a center point of said foot plate, and a plurality of short tick line symbol markings are indicated at every inch from said origin, in either of two directions from said origin marking of said origin, and a larger tick line symbol marking than said short tick line symbol marking at every 6 inches from said origin marking of said origin.

7. The golf training apparatus device according to claim 1, further comprising at least one or more of:

a swing plate coupled to a rotatable swing slide coupled to and configured to slide along said first ball plate, and configured to allow for rotation of said swing plate via an axle;

a swing plate coupled to a rotatable swing slides coupled to and configured to slide along said first ball plate, and configured to allow for rotation of said swing plate via an axle coupled at a center point of said swing plate;

a second ball plate comprising a swing plate, said second ball plate coupled to said first ball plate;

a second ball plate coupled to said first ball plate;

a second ball plate rotatably coupled to said first ball plate;

a second ball plate coupled at a center point of said second ball plate, perpendicularly to an end of said first ball plate;

a second ball plate rotatably coupled at a midpoint of said second ball plate, perpendicularly to an end of said first ball plate;

a second ball plate rotatably coupled at a center point of said second ball plate, perpendicularly to an end of said first ball plate, wherein said first ball plate and said second ball plate are of different lengths;

a second ball plate rotatably coupled at a center point of said second ball plate, configured to be capable of being aligned perpendicularly to an end of said first ball plate, wherein said first ball plate and said second ball plate are of different lengths and coupled by at least one axle; or a second ball plate rotatably coupled at a center point of said second ball plate, configured to be capable of being aligned perpendicularly to an end of said first ball plate, wherein said first ball plate and said second ball plate are of different lengths and coupled by at least one axle, wherein said axle comprises a cylindrical screw coupling said second ball plate to said first ball plate.

8. The golf training apparatus device according to claim 1, wherein said foot slide comprises at least one or more of:

an upper portion and a lower portion coupled to one another forming said channel therethrough of sufficient area to allow said foot plate to slide therethrough;

a plurality of portions, said plurality of portions coupled to one another, and at least one of said plurality of portions forming said channel therethrough of sufficient area to allow said foot plate to slide linearly therethrough;

a plurality of portions, said plurality of portions coupled to one another, and at least one of said plurality of portions forming said channel therethrough of sufficient area to allow said foot plate to slide linearly therethrough, and wherein at least one of said plurality of portions comprises a cross-section comprising at least one of: a c-shape, a u-shape, a v-shape, or a j-shape;

a plurality of portions, said plurality of portions coupled to one another by a plurality of screws;

an upper portion comprising an origin and angular protractor angle indications of a plurality of angles; or an upper portion comprising a plurality of origins on each of a left and a right side, each indicating angular protractor angle indications of a plurality of angles.

9. The golf training apparatus device according to claim 1, wherein said axle comprises at least one or more of:

a barrel type fastener;
a screw and a nut;
a rivet;
a low profile rivet;
a plastic screw;
a metal screw;
a threaded screw and threaded hole;
a self-threading screw;
a cylindrical member; or
a rotatable lazy-susan ball bearing coupling.

10. The golf training apparatus device according to claim 1, wherein said foot plate further comprises at least one or more of:

a foot coupled to an end of said foot plate;

a foot coupled to an end of said foot plate configured to prevent said foot plate from sliding out of said foot slide in at least one direction;

a foot coupled at an end of said foot plate configured to contact the ground at the end of said footplate;

a plurality of feet each coupled at a respective end of said foot plate;

a plurality of feet each coupled at a respective end of said foot plate configured to prevent said foot plate from sliding out of said foot slide in either direction; or a plurality of feet each coupled at a respective end of said foot plate configured to contact the ground at the respective ends of the footplate.

11. The golf training apparatus device according to claim 1, wherein at least one of said foot plate, said ball plate, a swing plate, said foot slide, said ball slide, a swing slide, or a telescoping member are manufactured from a metal material comprising at least one or more of:

aluminum,
magnesium,
steel,
stainless steel, or
titanium.

12. The golf training apparatus device according to claim 1, wherein at least one of said foot plate, said ball plate, a swing plate, said foot slide, said ball slide, a swing slide, or a telescoping member are manufactured from a material comprising at least one or more of:

a metal,
polymer,
plastic,
wood,
bamboo,
carbon fiber composite,
synthetic,
hybrid,
composite,
polyolefins,
polycarbonate,
polyvinyl chloride (PVC),
Polyurethanes,
Cyanoacrylate adhesive,
Nylon,
Polyester,
Kevlar,
Graphite,
Boron,
Wood,
Metal,
Iron,
Zinc,
Synthetic leather,
Rubber,
Neoprene,
Cloth,
Rubber,
Silicone rubber,
Polymers,
Fillers,
Vulcanizing agents,
Processing aids,
ABS plastic,
Additive manufacturing extruded materials,
S-glass materials,
Silicon dioxide,
Aluminum oxide,
Magnesium oxide,
Calcium oxide,
Aluminum oxide,
Boron,
Polyoxymethylene,
Thermoplastic Polyester Elastomer,
Polybutylene Terephthalate,
Polyethylene Terephthalate,
gutta-percha/polyisoprene,
surlyn copolymer,
Die cast aluminum,
heavy section steel (HST),
wood and metal,
Carbon steel,
Aluminum Sulfate,
AL 6061-T6,
Anodized Aluminum,
anodized clear finish,
6061 aluminum,
304 stainless steel,
431 stainless steel,
17-4 stainless steel
6-4 Titanium,
15-5 stainless steel,
Beta titanium,
Maraging metal,
cellular,
ceramic,
glass,
aluminum,
steel,
stainless steel, or
titanium.

13. The golf training apparatus device of claim 1, wherein said first ball plate comprises said plurality of golf ball markings, wherein each of said golf ball markings comprise a circle, and adjacent circles are equally spaced apart; and further comprising a telescoping member rotatably coupled to the golf training apparatus device.

14. A golf training apparatus device comprising:

a first ball plate of rectangular dimensions including a plurality of golf ball markings on a substantially flat surface;

a ball slide of rectangular dimensions including a first channel configured to slideably receive said first ball plate as a linear guide and configured to enable linear sliding motion of said first ball plate relative to said ball slide in said first channel;

a foot plate of rectangular dimensions; and a foot slide of rectangular dimensions including a second channel configured to slideably receive said foot plate as a linear guide and configured to enable linear sliding motion of said foot plate relative to said foot slide in said second channel, wherein said foot slide is coupled to said ball slide; and at least one or more of:

a telescoping member configured to extend outward in at least one direction, and wherein said telescoping member is coupled to at least one or more of:

said first ball plate, said ball slide, said foot plate, or said foot slide;

a telescoping member configured to extend outward in at least one direction, and wherein said telescoping member is coupled to at one end of at least one or more of:

said first ball plate, said ball slide, said foot plate, or said foot slide;

a telescoping member comprising at least two members coupled to one another and configured to telescope outward relative to one another;

a telescoping member comprising at least three members coupled to one another and configured to telescope outward relative to one another;

a telescoping member comprising a plurality of members coupled to one another and comprising at least one stop to allow extension to a given telescoping distance;

a telescoping member comprising a plurality of members coupled to one another and comprising at least one stop to allow extension linearly to a given telescoping distance;

a telescoping member comprising a least three members coupled to one another and comprising at least one stop to allow extension linearly to a given telescoping distance;

a telescoping member comprising a least three members coupled to one another and comprising at least one stop to allow extension linearly to a given telescoping distance and wherein two of said at least three members include a notch to avoid interference with a rotational access of said telescoping member;

a telescoping member comprising at least one opening for receiving at least one axle to allow rotation about the axle, in any of various angular directions;

a telescoping member comprising at least one opening for receiving at least one axle to allow rotation about the axle, in any of various angular directions of one or more of: up to 45 degrees in one direction, up to 90 degrees in one direction, up to 180 degrees in one direction, up to 360 degrees in one direction, up to 45 degrees in either of two directions, up to 90 degrees in either of two directions, up to 180 degrees in either of two directions, or up to 360 degrees in either of two directions;

a telescoping member rotatably coupled to at least one axle via a screw and barrel connector;

a telescoping member rotatably coupled to at least one axle via a screw and nut connector;

a telescoping member rotatably coupled to at least one axle via a rivet connector;

a telescoping member rotatably coupled to at least one axle via a low profile rivet connector;

a plurality of telescoping members coupled to at least one axle;

a plurality of telescoping members coupled to at least one slide;

a plurality of telescoping members rotatably coupled to at least one slide; or a plurality of telescoping members, wherein each of said plurality of said telescoping members is coupled at one end to at least one or more of:

said first ball plate, said ball slide, said foot plate, or said foot slide.

15. The golf training apparatus device according to claim 14, wherein said telescoping member is coupled at a perpendicular angle to at least one or more of:

said first ball plate, said ball slide, said foot plate, or said foot slide.

16. The golf training apparatus device according to claim 14, wherein said telescoping member is coupled to at least one axle, and at least one or more of:

wherein said telescoping member is rotatably coupled to at least one or more of:

said first ball plate, said ball slide, said foot plate, or said foot slide;

wherein said telescoping member is rotatably coupled via the at least one axle to a top portion of said foot slide and wherein a bottom portion of said foot slide is coupled by at least one axle to said ball slide, and wherein said telescoping member, said foot slide, and said ball slide rotate independently of each other;

wherein said telescoping member is rotatably coupled via the at least one axle to a top portion of said foot slide and is configured to rotate within a range of negative 90 degrees from an origin to positive 90 degrees from the origin, and wherein a bottom portion of said foot slide is coupled by at least one axle to said ball slide and said foot slide and said ball slide may rotate 360 degrees, and wherein said telescoping member and said foot slide are limited in rotation relative to one another, and said ball slide rotates independently of the telescoping slide;

wherein said telescoping member is rotatably coupled via the at least one axle to a portion of said foot slide and wherein a portion of said foot slide is coupled by at least one axle to said ball slide, and wherein said telescoping member, said foot slide, and said ball slide rotate independently of each other; or wherein said telescoping member is rotatably coupled via the at least one axle to a portion of said foot slide and is configured to rotate within a range of negative 90 degrees from an origin to positive 90 degrees from the origin, and wherein a portion of said foot slide is coupled by at least one axle to said ball slide and said foot slide and said ball slide may rotate 360 degrees, and wherein said telescoping member and said foot slide are limited in rotation relative to one another, and said ball slide rotates independently of the telescoping slide.

17. The golf training apparatus device according to claim 14, further comprising at least one or more of:

a swing plate coupled to a rotatable swing slide coupled to and configured to slide along said first ball plate, and configured to allow for rotation of said swing plate via an axle;

a swing plate coupled to a rotatable swing slide coupled to and configured to slide along said first ball plate, and configured to allow for rotation of said swing plate via an axle coupled at a center point of said swing plate;

a second ball plate comprising a swing plate, said second ball plate coupled to said first ball plate;

a second ball plate coupled to said first ball plate;

a second ball plate rotatably coupled to said first ball plate;

a second ball plate coupled at a center point of said second ball plate, perpendicularly to an end of said first ball plate;

a second ball plate rotatably coupled at a midpoint of said second ball plate, perpendicularly to an end of said first ball plate;

a second ball plate rotatably coupled at a center point of said second ball plate, perpendicularly to an end of said first ball plate, wherein said first ball plate and said second ball plate are of different lengths;

a second ball plate rotatably coupled at a center point of said second ball plate, configured to be capable of being aligned perpendicularly to an end of said first ball plate, wherein said first ball plate and said second ball plate are of different lengths and coupled by at least one axle;

a second ball plate rotatably coupled at a center point of said second ball plate, configured to be capable of being aligned perpendicularly to an end of said first ball plate, wherein said first ball plate and said second ball plate are of different lengths and coupled by at least one axle, wherein said axle comprises a cylindrical screw coupling said second ball plate to said first ball plate;

a foot coupled to an end of said foot plate;

a foot coupled to an end of said foot plate configured to prevent said foot plate from sliding out of said foot slide in at least one direction;

a foot coupled at an end of said foot plate configured to contact the ground at the end of said footplate;

a plurality of feet each coupled at a respective end of said foot plate;

a plurality of feet each coupled at a respective end of said foot plate configured to prevent said foot plate from sliding out of said foot slide in either direction; or a plurality of feet each coupled at a respective end of said foot plate configured to contact the ground at the respective ends of the footplate.

18. A golf training apparatus device comprising:

a first ball plate of rectangular dimensions including a plurality of golf ball markings on a substantially flat surface;

a ball slide of rectangular dimensions including a first channel configured to slideably receive said first ball plate as a linear guide and configured to enable linear sliding motion of said first ball plate relative to said ball slide in said first channel;

a foot plate of rectangular dimensions; and a foot slide of rectangular dimensions including a second channel configured to slideably receive said foot plate as a linear guide and configured to enable linear sliding motion of said foot plate relative to said foot slide in said second channel, wherein said foot slide is coupled to said ball slide; and wherein said foot slide coupled to said ball slide and said first ball plate and said foot plate are all configured to rotate into alignment for storage.

19. The golf training apparatus device of claim 18, wherein said first ball plate comprises said plurality of golf ball markings, wherein each of said golf ball markings comprise a circle, and adjacent circles are equally spaced apart; and further comprising a telescoping member rotatably coupled to the golf training apparatus device.

20. The golf training apparatus device according to claim 18, further comprising at least one or more of:

a swing plate coupled to a rotatable swing slide coupled to and configured to slide along said first ball plate, and configured to allow for rotation of said swing plate via an axle;

a swing plate coupled to a rotatable swing slide coupled to and configured to slide along said first ball plate, and configured to allow for rotation of said swing plate via an axle coupled at a center point of said swing plate;

a second ball plate comprising a swing plate, said second ball plate coupled to said first ball plate;

a second ball plate coupled to said first ball plate;

a second ball plate rotatably coupled to said first ball plate;

a second ball plate coupled at a center point of said second ball plate, perpendicularly to an end of said first ball plate;

a second ball plate rotatably coupled at a midpoint of said second ball plate, perpendicularly to an end of said first ball plate;

a second ball plate rotatably coupled at a center point of said second ball plate, perpendicularly to an end of said first ball plate, wherein said first ball plate and said second ball plate are of different lengths;

a second ball plate rotatably coupled at a center point of said second ball plate, configured to be capable of being aligned perpendicularly to an end of said first ball plate, wherein said first ball plate and said second ball plate are of different lengths and coupled by at least one axle;

a second ball plate rotatably coupled at a center point of said second ball plate, configured to be capable of being aligned perpendicularly to an end of said first ball plate, wherein said first ball plate and said second ball plate are of different lengths and coupled by at least one axle, wherein said axle comprises a cylindrical screw coupling said second ball plate to said first ball plate;

a foot coupled to an end of said foot plate;

a foot coupled to an end of said foot plate configured to prevent said foot plate from sliding out of said foot slide in at least one direction;

a foot coupled at an end of said foot plate configured to contact the ground at the end of said footplate;

a plurality of feet each coupled at a respective end of said foot plate;

a plurality of feet each coupled at a respective end of said foot plate configured to prevent said foot plate from sliding out of said foot slide in either direction; or a plurality of feet each coupled at a respective end of said foot plate configured to contact the ground at the respective ends of the footplate.

* * * * *